US011988479B1

(12) United States Patent
Herring

(10) Patent No.: US 11,988,479 B1
(45) Date of Patent: May 21, 2024

(54) BOLT CARRIER MOVEMENT MECHANISM PROVIDING PRIMARY EXTRACTION FORCE MULTIPLICATION, FIREARMS COMPRISING SAME, KITS FOR CONSTRUCTING FIREARMS COMPRISING SAME, AND BOLT CARRIER GROUPS FOR ENABLING SAME

(71) Applicant: Ares Defense Systems, Inc., Melbourne, FL (US)

(72) Inventor: Geoffrey A. Herring, Melbourne, FL (US)

(73) Assignee: Ares Defense Systems, Inc., Melbourne, FL (US)

( * ) Notice: Subject to any disclaimer, the term of this patent is extended or adjusted under 35 U.S.C. 154(b) by 0 days.

(21) Appl. No.: 18/466,618

(22) Filed: Sep. 13, 2023

(51) Int. Cl.
*F41A 15/14* (2006.01)
*F41A 3/26* (2006.01)
(Continued)

(52) U.S. Cl.
CPC ..... *F41A 3/26* (2013.01); *F41A 3/66* (2013.01); *F41A 3/72* (2013.01); *F41A 5/18* (2013.01); *F41A 15/14* (2013.01); *F41A 35/06* (2013.01)

(58) Field of Classification Search
CPC .. F41A 15/12; F41A 15/14; F41A 3/26; F41A 3/66; F41A 5/18
See application file for complete search history.

(56) References Cited

U.S. PATENT DOCUMENTS 30,446 A 10/1860 Henry
460,786 A 10/1891 Savage
(Continued)

FOREIGN PATENT DOCUMENTS

EP 3203178 A1 8/2017
WO 9725580 7/1997

OTHER PUBLICATIONS

Firearms Manual: Tombstone [On-Line]. 2022, [Retrieved on Jan. 28, 2023], Retrieved from Internet: <https://pof-usa.com/wp-content/uploads/2022/11/OWNMAN-TOMBSTONE-WEB.pdf >.
(Continued)

*Primary Examiner* — J. Woodrow Eldred
(74) *Attorney, Agent, or Firm* — David O. Simmons; IVC Patent Agency

(57) ABSTRACT

Disclosed herein are bolt carrier movement mechanisms that offer a higher ratio of bolt carrier applied force to user applied bolt action operating force. Such bolt carrier movement mechanism may comprise a bolt carrier, an impingement body, a primary extraction leverage member, and an action control structure coupler. The impingement body has at least one impingement surface. The primary extraction leverage member has a coupler mounting portion, an impingement member portion, and a bolt carrier mounting portion. The primary extraction leverage member is engaged at the bolt carrier mounting portion of the bolt carrier. The impingement member portion of the primary extraction leverage member is adjacent to the at least one impingement surface of the impingement body and includes at least one impingement member. The action control structure coupler is pivotably engaged with the coupler mounting portion of the primary extraction leverage member.

30 Claims, 21 Drawing Sheets

(51) Int. Cl.

| | |
|---|---|
| ***F41A 3/66*** | (2006.01) |
| ***F41A 3/72*** | (2006.01) |
| ***F41A 5/18*** | (2006.01) |
| ***F41A 35/06*** | (2006.01) |

(56) References Cited

U.S. PATENT DOCUMENTS

| | | | | |
|---|---|---|---|---|
| 491,138 | A | 2/1893 | Savage | |
| 502,018 | A | 7/1893 | Savage | |
| 549,345 | A | 11/1895 | Browning | |
| 634,034 | A | 10/1899 | Savage | |
| 2,484,694 | A | 10/1949 | Dicke | |
| 2,606,383 | A | 8/1952 | Jensen | |
| 2,765,559 | A | 10/1956 | Morris | |
| 2,777,234 | A | 1/1957 | Neal | |
| 2,881,547 | A | 4/1959 | Butlet | |
| 3,377,731 | A | 4/1968 | Lawrence | |
| 6,389,725 | B1 * | 5/2002 | Denuit | F41A 9/56 42/25 |
| 9,328,990 | B2 | 5/2016 | Giannelli et al. | |
| 9,784,514 | B1 * | 10/2017 | Carr | F41A 15/14 |
| 2013/0125440 | A1 * | 5/2013 | Zheng | F41A 15/14 42/14 |
| 2017/0227318 | A1 | 8/2017 | Yaka et al. | |
| 2023/0304755 | A1 | 9/2023 | Tusting et al. | |

OTHER PUBLICATIONS

Bond Arms Lever-Action (Coming Soon) [On-Line]. 2023, [Retrieved on Jan. 28, 2023], Retrieved from Internet: <https://www.bondarms.com/Bond-Arms-Lever-Action-Coming-Soon-P8583.aspx#descPane >.

Kurylyk Z., "Lever action: The next tactical frontier?" Calibre: The Canadian Firearms Magazine, https://calibremag.ca/lever-action-the-next-tactical-frontier/, Mar. 9, 2021, Accessed on Dec. 29, 2023.

Brickwurx Mfg., "Brickwurx Mfg. Lever Action AR-15, Initial Cycle Test (Red Ryd / Christmas-15)," YouTube, https://www.youtube.com/watch?v=SbXWqatpito, Aug. 16, 2019, Accessed on Dec. 29, 2023.

* cited by examiner

BOLT CARRIER MOVEMENT MECHANISM PROVIDING PRIMARY EXTRACTION FORCE MULTIPLICATION, FIREARMS COMPRISING SAME, KITS FOR CONSTRUCTING FIREARMS COMPRISING SAME, AND BOLT CARRIER GROUPS FOR ENABLING SAME

FIELD OF THE DISCLOSURE

The disclosures made herein relate generally to firearm design and methods of manufacture thereof and, more particularly, to a bolt carrier movement mechanism that provides primary extraction force multiplication in firearms and especially in rotating-bolt firearms with a manually-energized bolt carrier movement mechanism.

BACKGROUND

It is well known by both firearm designers (e.g., gunsmiths) and firearm shooters (e.g., shooters that self-service their firearms) that extraction of a cartridge from within a chamber of a firearm generally includes primary and secondary extraction. Primary extraction refers to the initial phase of such cartridge extraction. In a rotating bolt firearm, primary extraction generally includes rotation of the bolt for unlocking the bolt lugs from the barrel extension protrusions (i.e., mating lugs) and the first few millimeters of rearward movement of the bolt carrier group (i.e., bolt carrier, bolt, etc.). During primary extraction, rearward movement of the bolt carrier group and the bolt's engagement with the cartridge is responsible for dislodging the cartridge from intimate contact between the exterior surface of the cartridge and the interior surface of the chamber. Primary extraction is followed by secondary extraction during which bolt travels sufficiently rearward for enabling the cartridge to be expelled from the receiver to thereby complete the action of cartridge extraction.

In the case of a spent round of ammunition, it is also well known in the art that the cartridge may become tightly engaged within the chamber due to frictional engagement between the cartridge and the sidewalls of the chamber. The frictional engagement can arise from a variety of factors, which may include dimension/tolerance considerations, cartridge and/or chamber design, cartridge re-use, case swelling during firing, and the like. As a result of the frictional engagement, primary extraction generally requires much higher force for initiating rearward movement of the bolt than does secondary engagement for continuing movement of the bolt to the cartridge ejection position.

With sufficiently elevated frictional engagement, primary extraction can be inhibited or otherwise restricted as a result of available force during routine operation of the firearm (i.e., the firearm remain in a current shooting position during extraction) for causing rearward movement of the bolt being inadequate for overcoming the frictional force. When the available force during routine operation of the firearm for causing rearward movement of the bolt becomes inadequate for overcoming the frictional force, the shooter of the firearm is required to take action that compromises use of the firearm (e.g., the shooter must move the firearm to a non-shooting orientation for enabling the shooter to apply adequate force to the firearm for causing primary extraction to be performed). In extreme cases, the firearm may become sufficiently jammed so as to require tools and the services of a gunsmith to rectify the jammed mechanism.

Therefore, a solution for limiting, if not eliminating, instances where a shooter of a rotating bolt firearm is unable to perform primary extraction of a cartridge in the firearm during its routine operation as a result of elevated frictional engagement between the cartridge(s) and the chamber of the firearm would be advantageous, desirable, and useful.

SUMMARY OF THE DISCLOSURE

Embodiments of the disclosures made herein are directed to bolt carrier movement mechanisms that provide improved primary extraction performance in rotating bolt firearms as compared to conventional bolt carrier movement mechanisms. Direct engagement of an operating member (e.g., rod, link, or the like) to a bolt carrier is an example of a conventional bolt carrier movement mechanisms, where force applied at a first end of the operating member is applied directly, albeit not necessarily in its entirety, to the bolt carrier. Bolt carrier movement mechanisms in accordance with the disclosures made herein are particularly beneficial in rotating-bolt firearms with a manually-energized bolt carrier movement mechanism. While the disclosures made herein generally are expressed with rotating-bolt firearms, persons skilled in the art will observe and appreciate that the present invention encompasses non-rotating bolt firearms such as those with tilting-bolt breech lock, roller-locked bolts and the like. In general, bolt carrier movement mechanisms in accordance with the disclosures made herein offer a higher ratio of bolt carrier applied (i.e., bolt carrier movement mechanism output) force to user applied (i.e., bolt carrier movement mechanism input) force. Accordingly, for a given bolt carrier movement mechanism input force, bolt carrier movement mechanisms in accordance with the disclosures made herein provide greater primary extraction force on a bolt carrier of a firearm (i.e., a high-ratio mechanism) than do conventional bolt carrier movement mechanisms (i.e., a low-ratio mechanism). For example, a high-ratio mechanism may provide an output force-to-input force ratio of 2 or greater whereas a low-ratio mechanism such as the direct engagement operating member mechanism discussed above may provide an output force-to-input force ratio of 1 or less.

In one or more embodiments of the disclosures made herein, a bolt carrier group comprises a bolt carrier and a primary extraction leverage member. The primary extraction leverage member has a coupler mounting portion, an impingement member portion, and a bolt carrier mounting portion. The primary extraction leverage member is pivotably engaged at the bolt carrier mounting portion thereof with the bolt carrier for enabling the primary extraction leverage member to pivot about a pivot axis extending through the bolt carrier mounting portion. The coupler mounting portion is positioned above a top surface of the bolt carrier when the primary extraction leverage member is in a battery-providing position.

In one or more embodiments of the disclosures made herein, a bolt carrier movement mechanism comprises a bolt carrier, an impingement body, a primary extraction leverage member, and an action control structure coupler. The impingement body has at least one impingement surface. The primary extraction leverage member has a coupler mounting portion, an impingement member portion, and a bolt carrier mounting portion. The primary extraction leverage member is pivotably engaged at the bolt carrier mounting portion thereof with the bolt carrier for enabling the primary extraction leverage member to pivot about a pivot axis extending through the bolt carrier mounting portion.

The impingement member portion of the primary extraction leverage member is adjacent to the at least one impingement surface of the impingement body and includes at least one impingement member. The action control structure coupler is pivotably engaged with the coupler mounting portion of the primary extraction leverage member.

In one or more embodiments of the disclosures made herein, a kit for constructing a firearm having a manually-energized bolt carrier movement mechanism comprises an impingement body, a primary extraction leverage member, a bolt carrier, and an action control structure coupler. The impingement body has at least one impingement surface. The primary extraction leverage member has a coupler mounting portion, an impingement member portion, and a bolt carrier mounting portion. The impingement member portion includes at least one impingement member. The bolt carrier is slidably disposable within a bolt carrier receiving bore of an upper receiver body of the firearm. The bolt carrier is adapted for having the bolt carrier mounting portion of the primary extraction leverage member pivotably engaged therewith. The action control structure coupler is pivotably engageable with the coupler mounting portion of the primary extraction leverage member.

In one or more embodiments of the disclosures made herein, a firearm comprises receiver body system, a bolt carrier, an impingement body, a primary extraction leverage member, an action control structure coupler, and an action control structure. The receiver body system includes an upper receiver body and a lower receiver body matingly attached to the upper receiver body. The bolt carrier is slidably disposed within a central bore of the upper receiver body. The impingement body has at least one impingement surface. The impingement body is engaged with at least one of the upper receiver body and the lower receiver body. The primary extraction leverage member has a coupler mounting portion, an impingement member portion, and a bolt carrier mounting portion. The primary extraction leverage member is pivotably engaged at the bolt carrier mounting portion thereof to the bolt carrier. The impingement member portion of the primary extraction leverage member includes at least one impingement member. The action control structure coupler has a first portion thereof pivotably engaged with the coupler mounting portion of the primary extraction leverage member. The action control structure coupler is engaged with a second portion of the action control structure coupler for enabling the bolt carrier to be cycled between a battery position and a fully displaced position.

In some embodiments of the disclosures made herein, the impingement body comprises a bolt catch.

In some embodiments of the disclosures made herein, the impingement body is integral with a bolt catch.

In some embodiments of the disclosures made herein, a lower receiver is provided and has a base portion of the impingement body unitarily-formed therewith from a first material, wherein a durable member portion of the impingement body is attached to the base portion of the impingement body and wherein the durable member portion of the impingement body has a hardness greater than the base portion of the impingement body.

In some embodiments of the disclosures made herein, a lower receiver is provided and has an impingement body receiving spaced formed within a wall thereof, wherein the lower receiver is formed from a first material, wherein the impingement body is a discrete component made from second material having a hardness greater than the first material, and wherein a base portion of the impingement body is disposed within the impingement body receiving space.

In some embodiments of the disclosures made herein, a lower receiver is provided and is formed from a first material, wherein the impingement body is a discrete component made from a second material having a hardness greater than the first material and wherein the impingement body is engaged with a wall of the lower receiver.

In some embodiments of the disclosures made herein, a base portion of the impingement body is engaged (e.g., slidably and/or detachably) engaged with the bolt carrier.

In some embodiments of the disclosures made herein, the bolt carrier mounting portion is located between the coupler mounting portion and the impingement member portion and the primary extraction leverage member provides a primary extraction force multiplication factor of at least 2 as a function of a distance from the pivot axis to a point of attachment of the primary extraction leverage member to the action control structure coupler and a distance from the pivot axis to an impingement body contact portion of the at least one impingement member.

In some embodiments of the disclosures made herein, the impingement member portion is located between the coupler mounting portion and the bolt carrier mounting portion and the primary extraction leverage member provides a primary extraction force multiplication factor of at least 3.5 as a function of a distance from the pivot axis to a point of attachment of the primary extraction leverage member to the action control structure coupler and a distance from the pivot axis to an impingement body contact portion of the at least one impingement member.

In some embodiments of the disclosures made herein, the action control structure coupler is a mounting body including at least one of a mounting portion adapted for having an operating rod engaged therewith and a mounting portion adapted for having a charging knob engaged therewith.

In some embodiments of the disclosures made herein, the action control structure coupler is a lever coupler pivotably attached at a first end portion thereof to the coupler mounting portion of the primary extraction leverage member and adapted at the second end portion thereof for having an action-control lever pivotably attached thereto.

In some embodiments of the disclosures made herein, the impingement body is slidably engaged with the bolt carrier and the action control structure coupler is slidably engaged with the bolt carrier.

In some embodiments of the disclosures made herein, the action control structure coupler is pivotably engaged with the coupler mounting portion of the primary extraction leverage member by a pivot pin extending through an elongated slot in the action control structure coupler.

In some embodiments of the disclosures made herein, a gas key is provided and is attached to the bolt carrier, wherein the gas key has a gas tube cavity with an inside diameter that is larger than that of an original equipment manufacturer (OEM) gas key of a firearm for which the firearm bolt carrier movement mechanism is adapted for used thereby permitting bypassing of gas between the gas tube cavity and an end portion of a gas tube disposed within the gas tube cavity.

In some embodiments of the disclosures made herein, a lower end portion of the primary extraction leverage member includes the at least one impingement member, the bolt carrier mounting portion, and a firing pin access passage.

In some embodiments of the disclosures made herein, bolt carrier movement mechanism may be configured for use with an unmodified upper receiver body that is compatible with an AR15 platform rifle.

In some embodiments of the disclosures made herein, the bolt carrier includes a first portion and a second portion slidably engaged with the first portion and the first portion includes at least one impingement portion adapted for being engaged by an impingement member portion of a primary extraction leverage member These and other objects, embodiments, advantages and/or distinctions of the present invention will become readily apparent upon further review of the following specification, associated drawings and appended claims.

DETAILED DESCRIPTION

Disclosed herein are aspects of bolt carrier movement mechanisms that offer improved primary extraction performance in manually-loaded firearms. Bolt carrier movement mechanisms in accordance with the disclosures made herein are particularly beneficial in rotating-bolt firearms with a manually-energized bolt carrier movement mechanism. More specifically, bolt carrier movement mechanisms in accordance with the disclosures made herein provide greater primary extraction force on a bolt carrier of a firearm than do conventional bolt carrier movement mechanisms (e.g., those not having a leverage amplifying structure integral with the bolt carrier).

Figure 1:
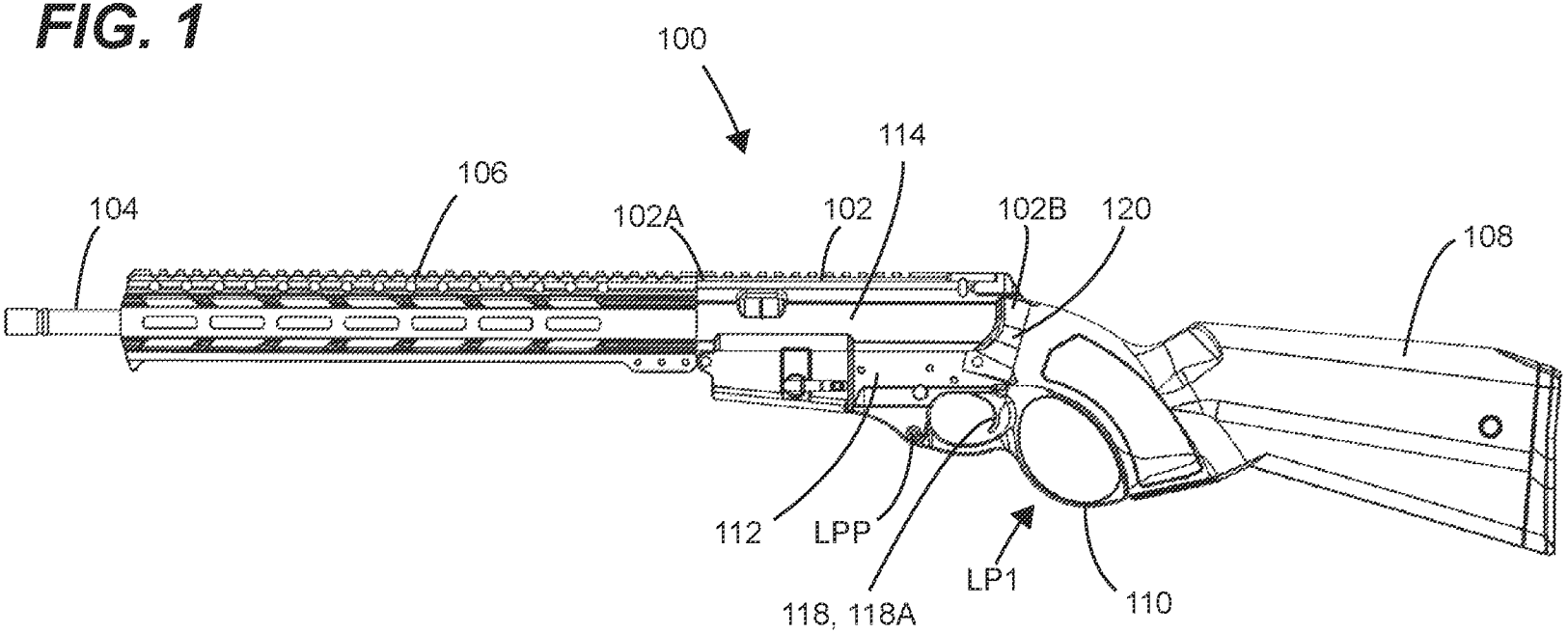
FIG. 1 is a side view of a lever-action rifle having a bolt carrier movement mechanism in accordance with a first embodiment of the disclosures made herein, with an action-control lever thereof in a battery-ready position.
Figure 2:
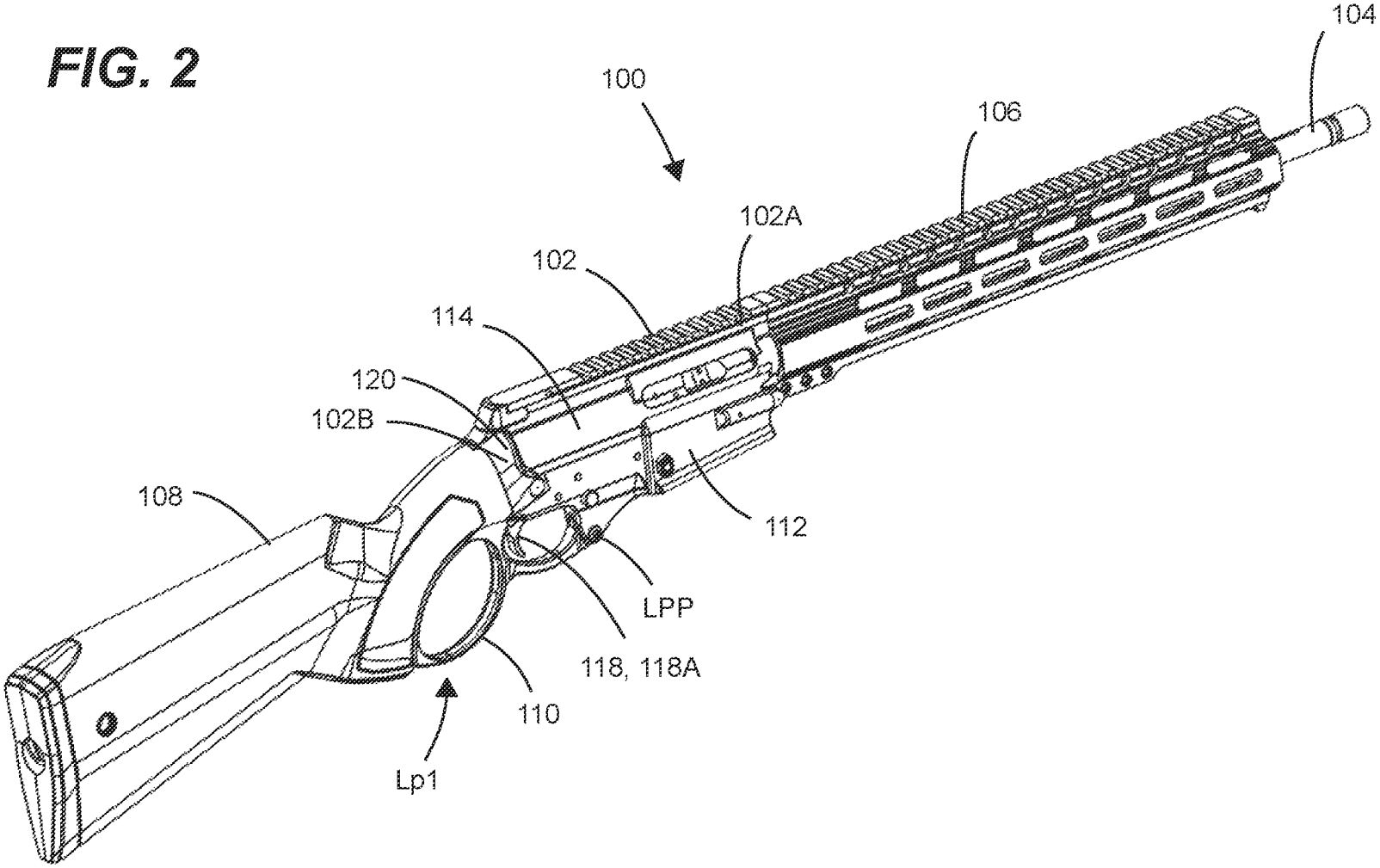
FIG. 2 is a first perspective view of the rifle shown in FIG. 1, with the action-control lever thereof in the battery-ready position.
Figure 3:
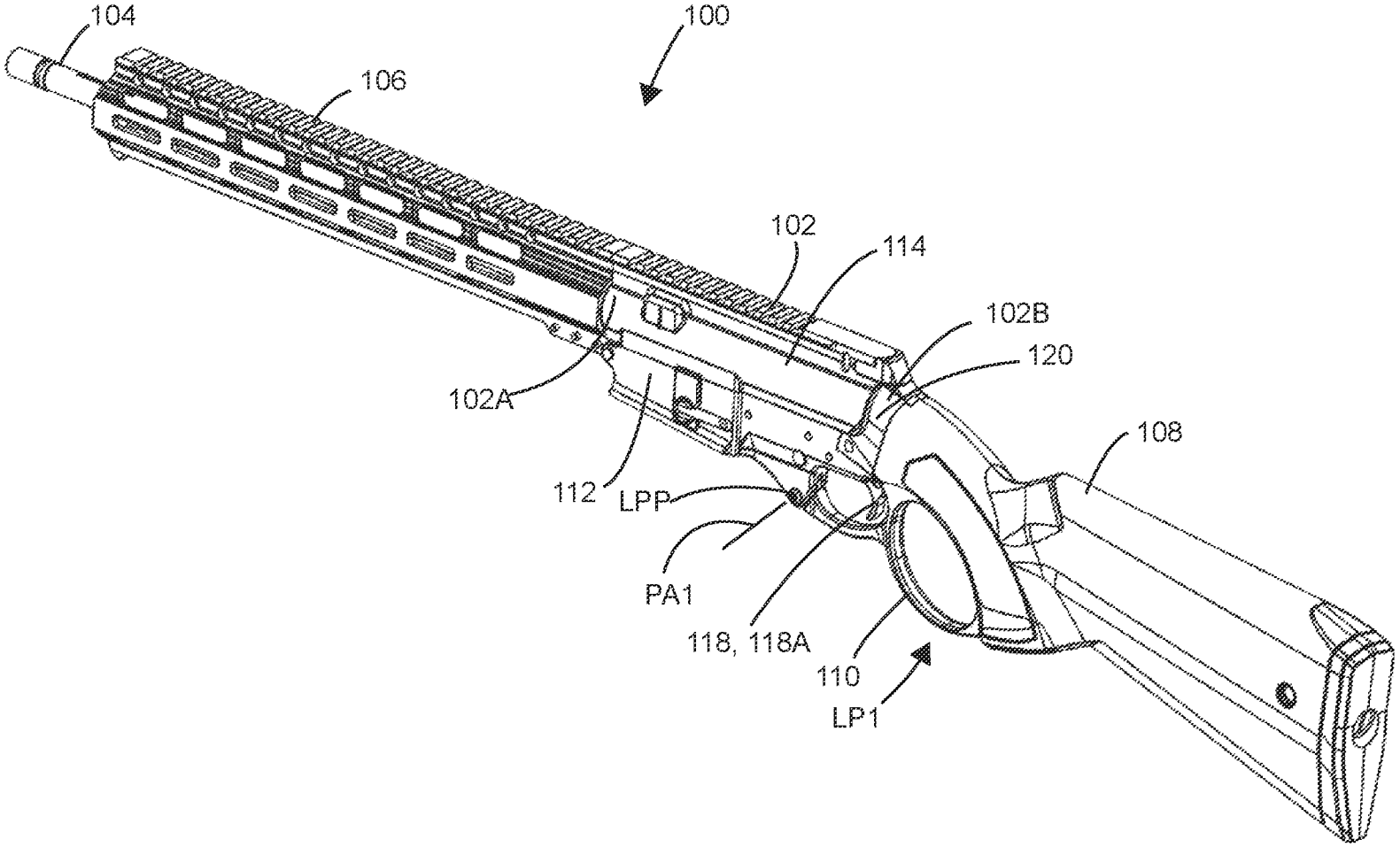
FIG. 3 is a second perspective view of the rifle shown in FIG. 1, with the action-control lever thereof in the battery-ready position.
Figure 4:
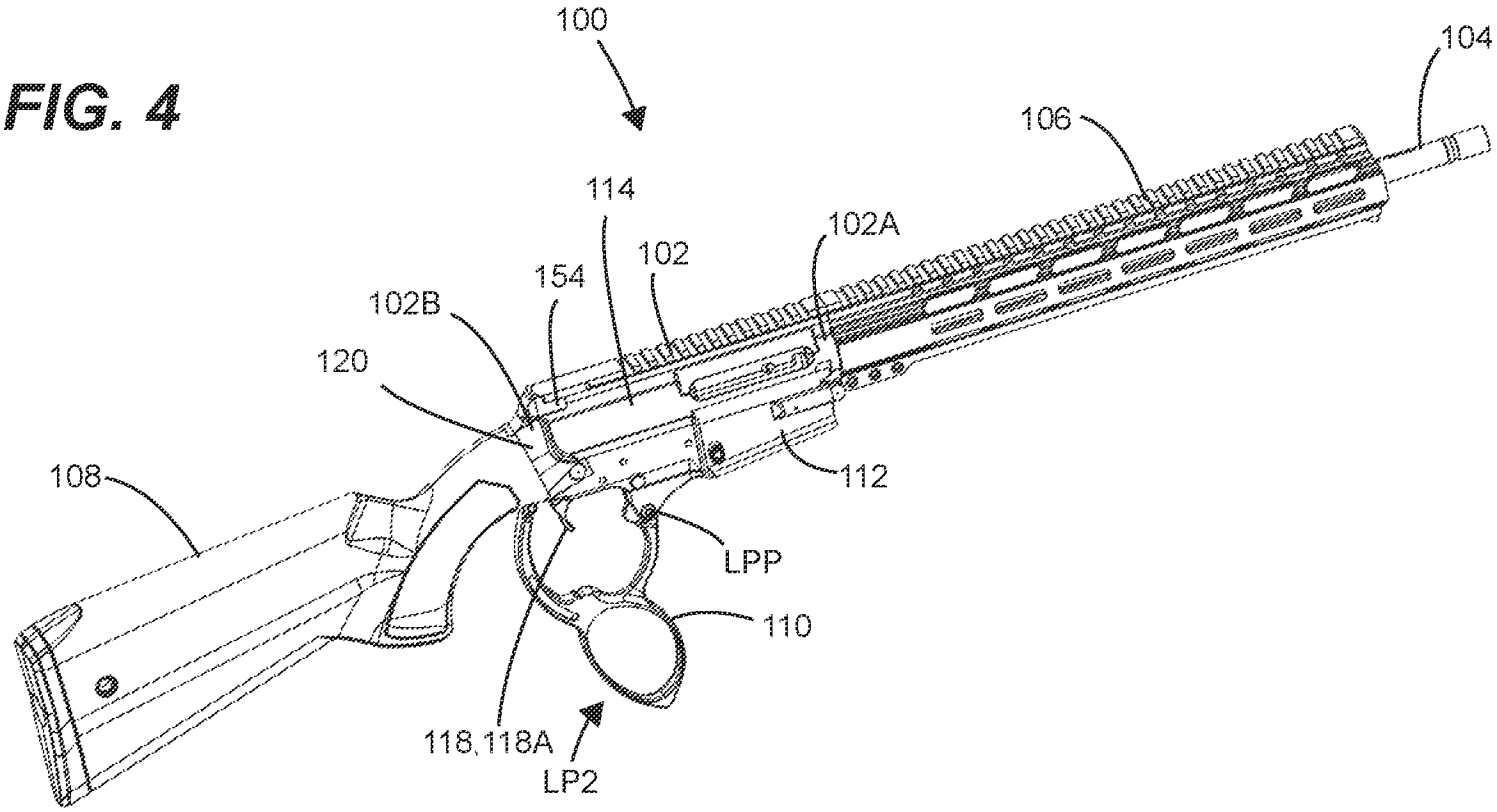
FIG. 4 is a third perspective view of the rifle shown in FIG. 1, with the action-control lever thereof in a cartridge-ejecting position.

FIGS. 1-22 depict various structural and functional aspects of a lever-action firearm (i.e., rifle 100) having a bolt carrier movement mechanism in accordance with a first embodiment of the disclosures made. As best shown in FIGS. 1-4, the rifle 100 includes a receiver system 102, a barrel 104, a handguard 106, a stock 108 (i.e., an accessory), and an action-control lever 110. While a stock is one example of an accessory engageable with a rear portion of a receiver body of a firearm, other examples of such an accessory include, but are not limited to, grips, pistol grips, stocks, stabilizing braces, and other accessories that enable stabilization at the rear end of the receiver body system. The barrel 104 and the handguard 106 are attached to a front end portion 102A of the receiver system 102. The stock 108 is attached to a rearend portion 102B of the receiver system 102. The action-control lever 110 is attached to the receiver system 102 at a lever pivot point LPP in a manner allowing the action-control lever 110 to be pivoted between a battery-ready position LP1 and a cartridge-ejecting position LP2 relative to the receiver system 102. The cartridge-ejecting position LP2 may be at a fully displaced position of the action-control lever 110 or a position between the battery-ready position LP1 and the cartridge-ejecting position LP2 As best shown in FIG. 3, the lever pivot point LPP defines a pivot axis PA1 about which the action-control lever 110 is constrained to pivot. Various components of the receiver system 102 (as well as components other than those of the receiver system 102) may be offered in kit form for enabling assembly of a firearm in accordance with one or more embodiments of the disclosures made herein.

Referring now to FIGS. 1-14, the receiver system 102 includes a lower receiver body 112, an upper receiver body 114, a bolt carrier 116 and a trigger assembly 118. The lower receiver body 112 and the upper receiver body 114 are operably attached to each other by a means that is well known in the art. The trigger assembly 118 is attached to the lower receiver body 112. The bolt carrier 116 is slidably disposed within a bolt carrier receiving bore 119 of the upper receiver body 114. As shown in FIGS. 6A, 6B, 7A and 7B, a firing pin 117 is slidably disposed within a mating passage of a bolt 115 carried by the bolt carrier 116. The lower receiver body 112 and the trigger assembly 118 are jointly configured such that a trigger 118A of the trigger assembly 118 is located directly (vertically) beneath a stock mounting flange 120 of the lower receiver body 112, thereby allowing the trigger 118A to be in a suitable position relative to the stock 108 of a rifle or shotgun. A gas key 113 is attached to atop surface of the bolt 116.

As best shown in FIGS. 5-12, in preferred embodiments, the lower receiver body 112 and the upper receiver body 114 may be configured in accordance with the AR-15 platform. In some embodiments, the upper receiver body 114 is an AR-15 platform compatible upper receiver body that was commercially-available prior to the year 2023 AD and the lower receiver body 112 is an AR-15 platform compatible lower receiver that is lever-action specific in accordance with the disclosures made herein. In some embodiments, the lower and upper receiver bodies 112, 114 are AR-15 platform compatible upper receiver bodies that were commercially-available prior to the year 2023 AD and the lower receiver body 112 is an AR-15 platform compatible lower receiver that is lever-action specific in accordance with the disclosures made herein.

As is well known in the art, when configured in accordance with the AR-15 platform, the lower receiver body 112 has spaced-apart front lugs 112A and spaced-apart rear lugs 112B and the upper receiver body 114 has a front lug 114A and rear lugs 114B. The front and rear lugs 114A, 114B of the upper receiver body 114 matingly and respectively engage the front and rear lugs 112A, 112B of the lower receiver body 112. The front and rear lugs 112A, 112B of the lower receiver body 112 and the front and a rear lug 114A, 114B of the upper receiver body 114 carry respective takedown pin bores (square, round, oval, squared-oval cross-sectional profiles or otherwise) for receiving a respective takedown pin. Additionally, the lower receiver body 112 has upper and rear surfaces that matingly and respectively engage lower and rear surfaces of the upper receiver body 114 whereby such engagement surfaces are each an engagement surface of a respective receiver body (e.g., the lower receiver body 112) that engage a respective and mating engagement surface of the other receiver body (e.g., the upper receiver body 114). The upper engagement surfaces of the lower receiver body 112 are defined by a trigger assembly well 121 (i.e., a rearend portion of the lower receiver body 112) and magazine well 122 (i.e., a frontend portion of the lower receiver body 112). The rear engagement surfaces of the lower receiver body 112 are defined by the stock mounting flange 120.

As best shown in FIGS. 5-9, the action-control lever 110 has a hand loop 130, a first attachment arm 132, and a second attachment arm 134. The first attachment arm 132 has a proximate end portion 132A fixedly attached to (e.g., unitary formed with) the hand loop 130. The second attachment arm 134 has a proximate end portion 134A fixedly attached to the hand loop 130. A distal end portion 132B of the first attachment arm 132 and a lever mounting portion 136 (e.g., a mounting flange) of the lower receiver body 112 are jointly configured to permit the distal end portion 132B of the first attachment arm 132 to be pivotably attached to the lever mounting portion 136 of the lower receiver body 112. Such pivotal attachment enables the hand loop (i.e., the action-control member 110) to pivot between the battery-ready position LP1 and the cartridge-ejecting position LP2. As shown in FIGS. 6A and 6B, the action-control lever 110 and the lower receiver body 112 jointly define a fully-enclosed trigger finger window (i.e., space in which the tripper 118A is located) with the action-control lever 110 in the battery-ready position LP1.

Figure 15:
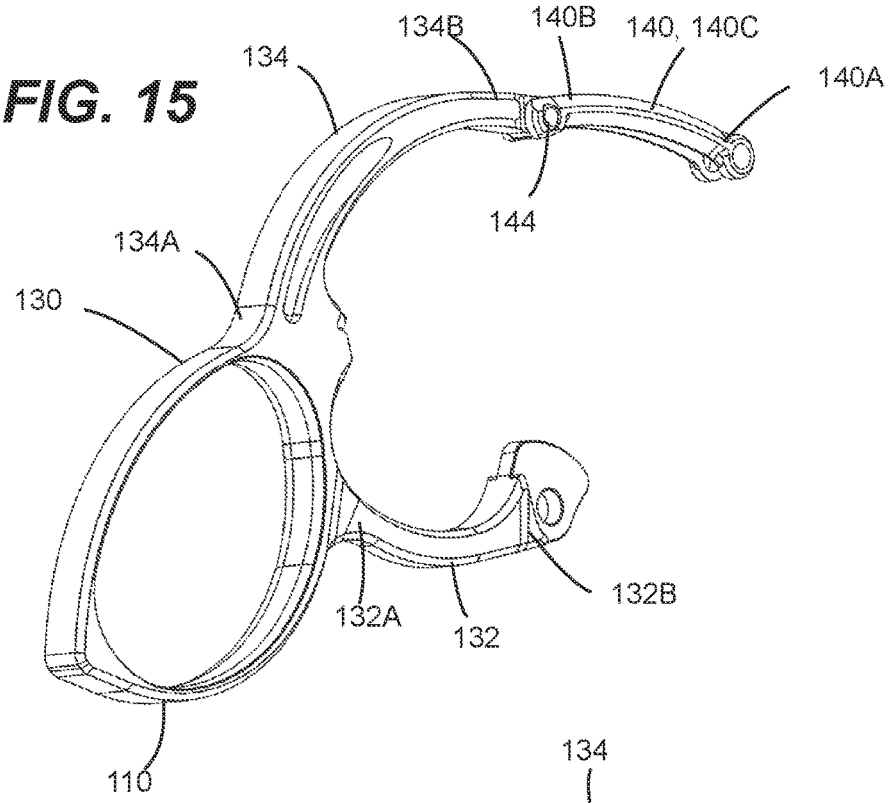
FIG. 15 is a first perspective view showing the hand lever and a linkage member of the rifle shown in FIG. 1.
Figure 16:
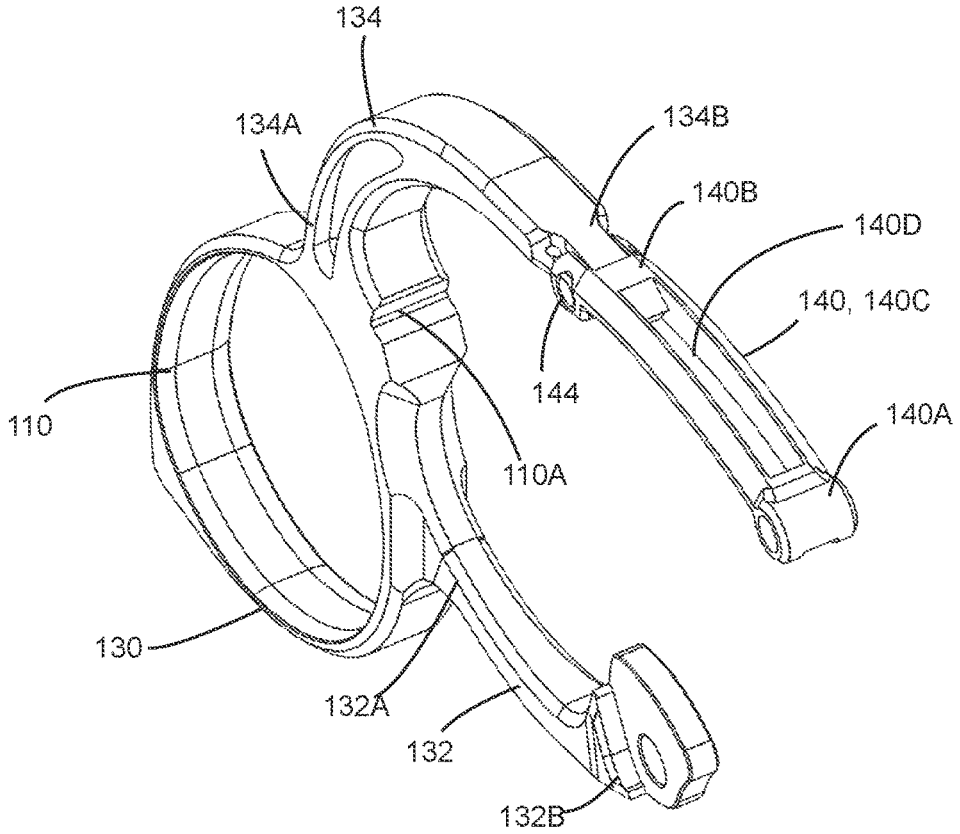
FIG. 16 is a second perspective view showing the hand lever and the linkage member of the rifle shown in FIG. 1.

The action-control lever 110 is coupled to the bolt carrier 116 through the second attachment arm 134 and, as most completely shown in FIGS. 15 and 16, a linkage member 140. The linkage member 140 has a first end portion 140A and a second end portion 140B. As discussed below in greater detail, the first end portion 140A of the linkage member 140 is attached to the bolt carrier 116 via an intermediate linkage member that affords a primary extraction force multiplication factor in accordance with embodiments of the disclosures made herein. A distal end portion 134B of the second attachment arm 134 is pivotably attached to the second end portion 140B of the linkage 140. A pin or other suitable type fastening member may be used for providing pivotable connections with the first and second end portions 140A, 140B and respective attached structure. The second attachment arm 134 and the linkage member 140 may thus jointly define a coupling assembly through which the hand loop 130 is coupled to the bolt carrier 116. In these regards, the action-control lever 110 and the linkage member 140 are jointly configured such that pivoting of the hand loop (e.g., the entire action-control member 110) between the battery-ready position LP1 and the cartridge-ejecting position LP2 causes the bolt carrier 116 to correspondingly slide within the bolt carrier receiving bore 119 between a battery position BP and an ejection position EP.

The lower receiver body 112 may have a retention member 141 (FIGS. 8 and 9) mounted thereon that is forcibly biased (e.g., spring-biased) into engagement with a mating structure 110A (FIGS. 8 and 16) of the action-control lever 110 (e.g., detent, groove, channel, or the like) for selectively retaining the action-control lever 110 in the battery-ready position LP1 to inhibit the action-control lever 110 from unintentional pivoting away from the battery-ready position LP1. The action-control lever 110 is an example of an action control structure configured in accordance with one or more embodiments of the disclosures made herein and the linkage member 140 is an example of an action control structure coupler configured in accordance with one or more embodiments of the disclosures made herein.

As best shown in FIGS. 6A, 6B, 7A, 7B, and 16, the linkage member 140 includes a hammer-receiving space 140D within a central portion 140C between its first and second end portions 140A, 140B. A head 117A of the firing pin 117 (FIGS. 6A, 6B, 7A and 7B) is located below the hammer-receiving space 140D. The hammer-receiving space 140D may be any suitable configuration for having an end portion of a hammer 118B of the trigger assembly 118 disposed therein when the hammer 118B is released to discharge a round of ammunition. Examples of the hammer-receiving space 140D include, but are not limited to, a channel within a lower surface of the linkage member 140 and a passage extending through upper and lower surfaces of the linkage member 140.

The second attachment arm 134 and the lower receiver body 112 are jointly configured such that the second attachment arm 134 extends through a passage 142 of the stock mounting flange 120 with the action-control lever 110 in the battery-ready position LP1. The passage 142 is within a central area of the stock flange 120 and is encompassed by a stock receptacle 120A of the stock mounting flange 120. The stock receptacle 120A receives a receiver engaging portion of a stock. In some embodiments, the stock receptacle 120A is compatible for being matingly engaged with the receiver engaging portion of a stock that is directly mountable on a shotgun (e.g., Remington brand, Winchester brand or Mossberg brand) that was commercially-available prior to the year 2022 AD.

Figure 9:
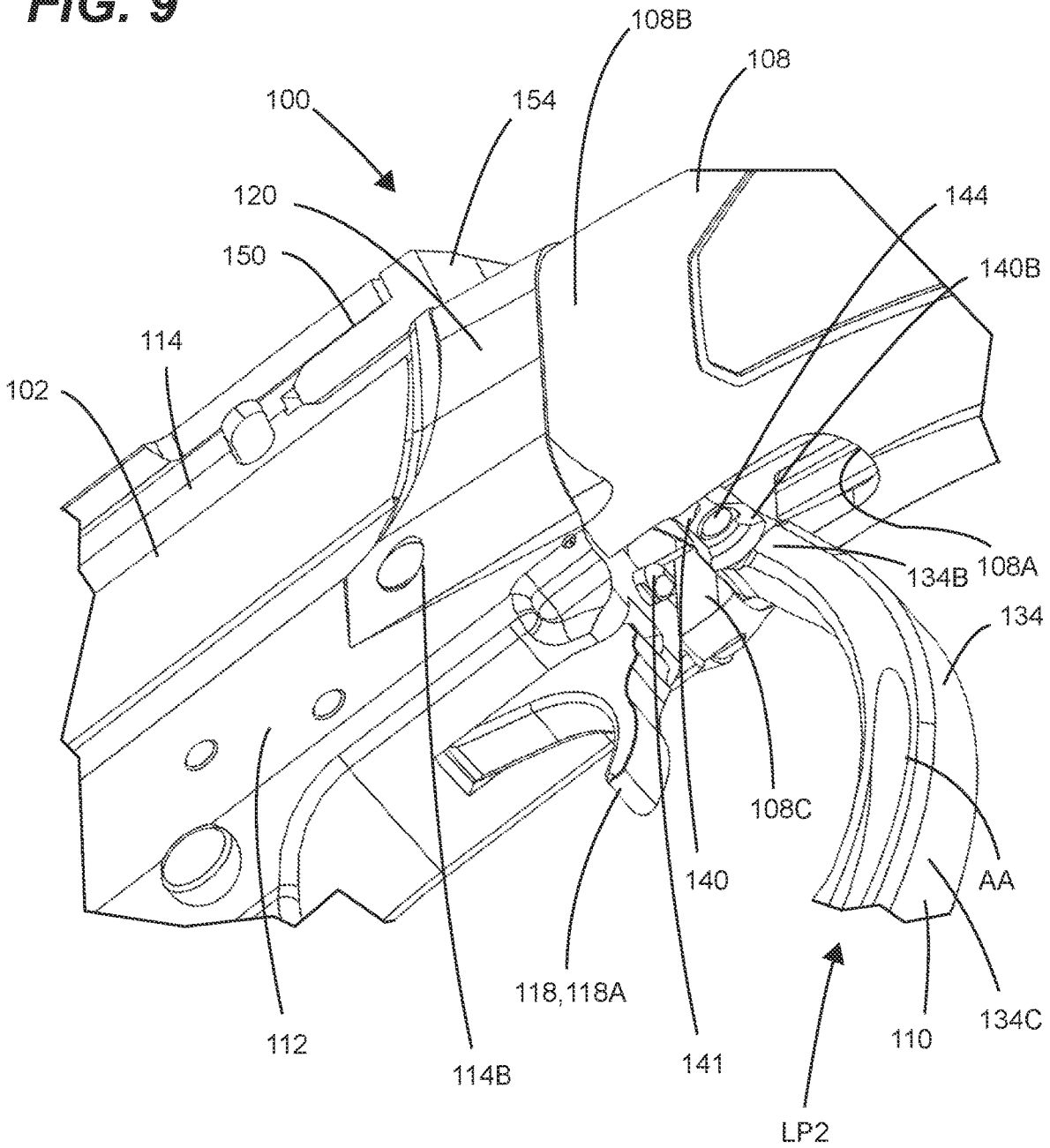
FIG. 9 is a partial perspective view showing aspects of the receiver system, trigger group, and action lever assembly of the rifle shown in FIG. 1.

Preferably, the second attachment arm 134 includes an arcuate segment 134C between the distal end portion 134B and the hand loop 130 with the arcuate segment 134C extending along an arcuate axis AA (FIG. 9). All points along the arcuate axis AA are equidistant (approximately or substantially) from the pivot axis PA1 about which the action-control lever 110 pivots between the battery-ready position LP1 and the cartridge-ejecting position LP2. With the hand loop 110 sufficiently moved from the battery-ready position LP1 to the cartridge-ejecting position LP2, the second attachment arm 134 moves out of the passage 142 and the linkage member 140 moves into the passage 142.

In some embodiments, as shown in FIG. 9, the stock 108 may include an attachment arm passage 108A within a bottom surface of its receiver engaging portion 108B. The second attachment arm 134 of the action-control lever 110 extends through the attachment arm passage 108A and through the stock mounting flange 120 with the action-control lever 110 in the battery-ready position LP1. The linkage member 140 may extend through the attachment arm passage 108A and through the stock mounting flange 120 with the action-control lever 110 sufficiently displaced from the battery-ready position LP1 toward the cartridge-ejecting position LP2, with the action-control lever 110 in the cartridge-ejecting position LP2, or both.

Physical and dimensional characteristics of the second attachment arm 134 and the linkage member 140 jointly permit sufficient translation of the bolt carrier 116 between the battery position BP and the ejection position EP for an associated respective amount of pivotal movement of the action-control lever 110 between the battery-ready position LP1 and the cartridge-ejecting position LP2. During such movements of the action-control lever 110 and the carrier 116, the second attachment arm 134 and the linkage member 140 are limited to doing so within the confines of available amount of space within the upper receiver body 114 and within the passage 142 of the stock mounting flange 120. For example, respective lengths, respective curvatures, respective cross-sectional dimensions, or combinations of the second attachment arm 134, the linkage member 140, or both may be specified to achieve a resulting movement characteristic (e.g., displacement magnitude, rate of displacement, etc.) of the carrier 116 for a given amount of pivotal movement of the action-control lever 110 and to correspondingly achieve required spatial positioning of the second attachment arm 134 and the linkage member 140 within the upper receiver body 114 and stock flange 120 during the aforementioned movements of the action-control lever 110 and the carrier 116.

Attachment of the linkage member 140 to the distal end portion 134B of the second attachment arm 134 provides a structure that enables detachment of the lower receiver body 112 and all associated components carried thereby from the upper receiver body 114 and all associated components carried thereby. For example, a pin 144 that pivotably adjoins the second end portion 140B of the linkage member 140 and the distal end portion 134B of the second attachment arm 134 may be removed from (e.g., pressed out of) engagement therewith for permitting separation of the linkage member 140 and the second attachment arm 134. Such separation decouples the only components of the receiver system 102 that connectedly span between the upper and lower receiver bodies 112, 114.

Figure 10:
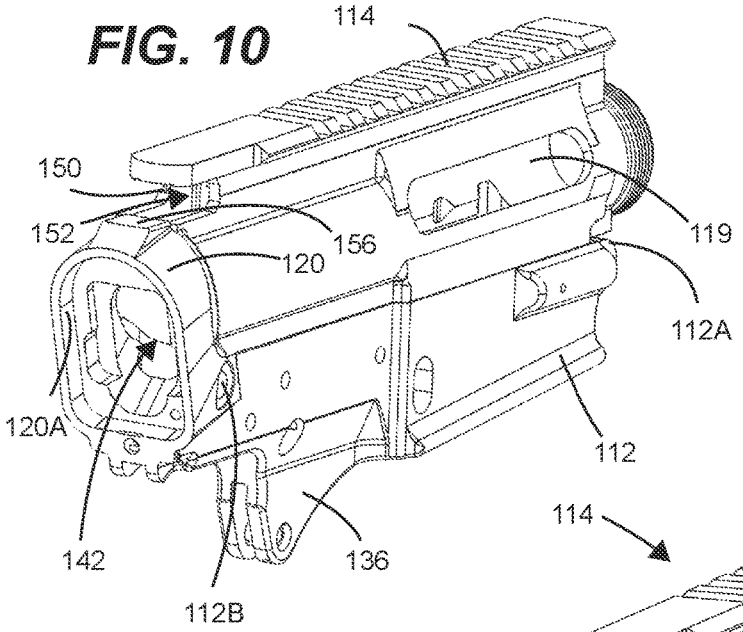
FIG. 10 is a perspective view showing the receiver body system of the rifle shown in FIG. 1.
Figure 11:
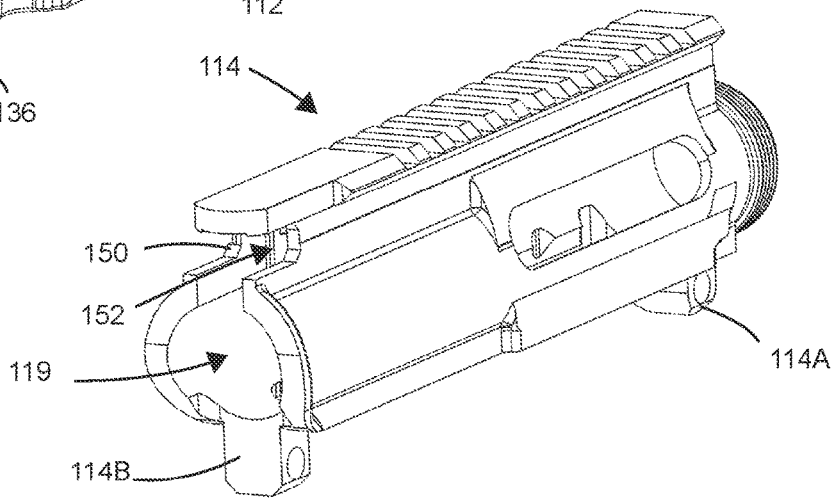
FIG. 11 is a perspective view showing the upper receiver body of the receiver system shown in FIG. 10.
Figure 12:
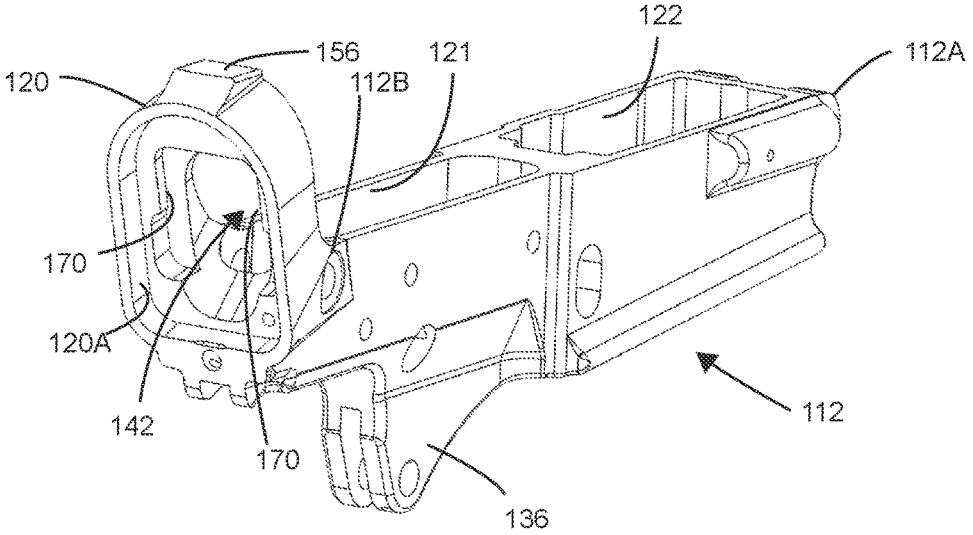
FIG. 12 is a perspective view showing the lower receiver body of the receiver system shown in FIG. 10.

As disclosed above, in some embodiments, the upper receiver body 114 may be an AR-15 platform compatible upper receiver body that was commercially-available prior to the year 2022 AD and the lower receiver body 112 is an AR-15 platform compatible lower receiver that is lever-action specific in accordance with the disclosures made herein. A skilled person will understand that the AR-15 platform compatible upper receiver body has a charging handle in place when used in semi-automatic firearm applications and that the charging handle is used for cycling the bolt of such a semi-automatic firearm from the battery position to the ejection position (i.e., the position causing a chambered cartridge to be ejected). As best seen in FIGS. 10 and 11, an AR-15 platform compatible upper receiver body includes a charging handle pocket 150 in which a head portion of the charging handle resides and a charging handle passage 152 in which an elongated member portion of the charging handle resides.

Figure 5:
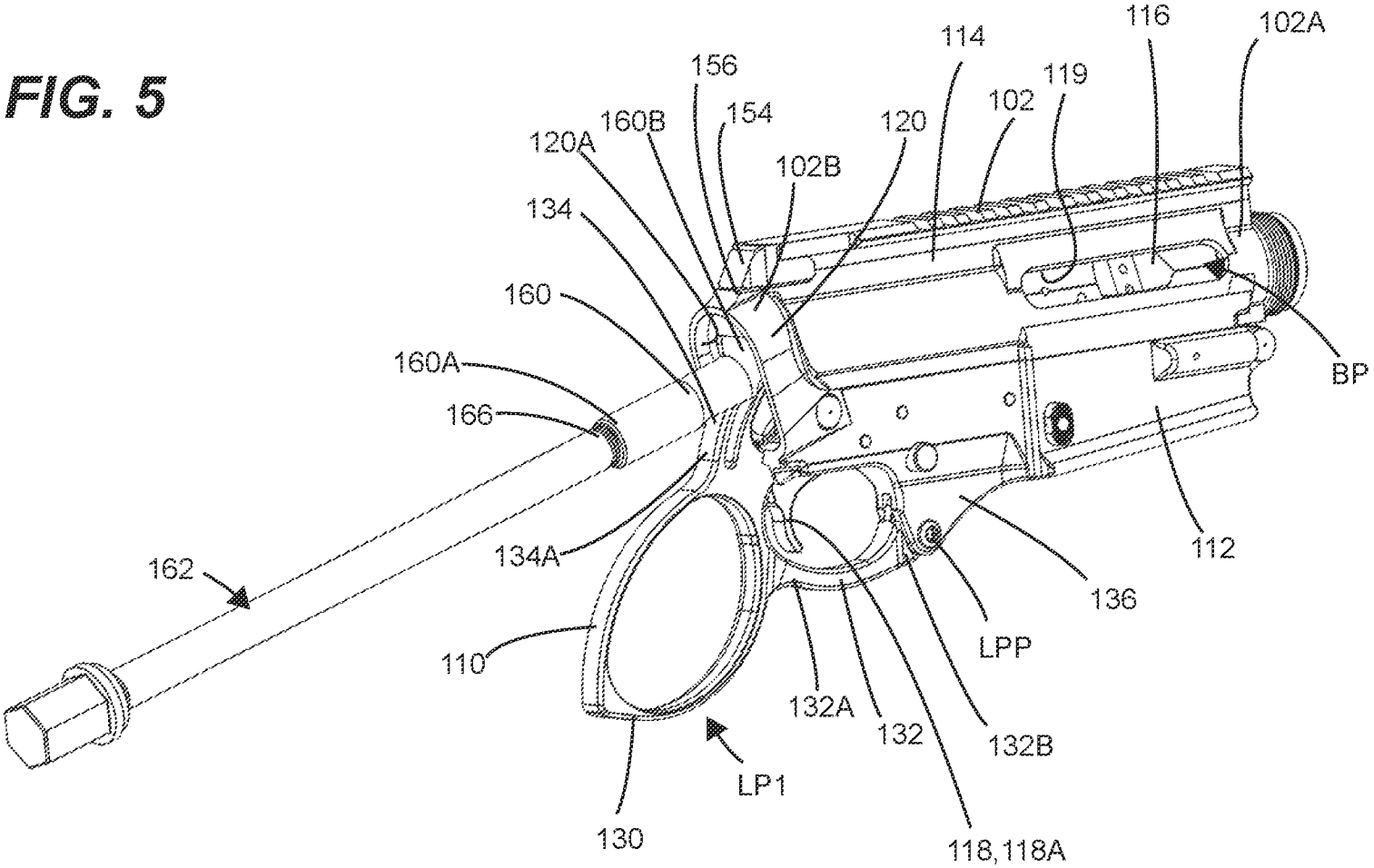
FIG. 5 is a perspective view showing a receiver system and accessory mounting components of the rifle shown in FIG. 1, with an action-control lever thereof in the battery-ready position.
Figure 6A:
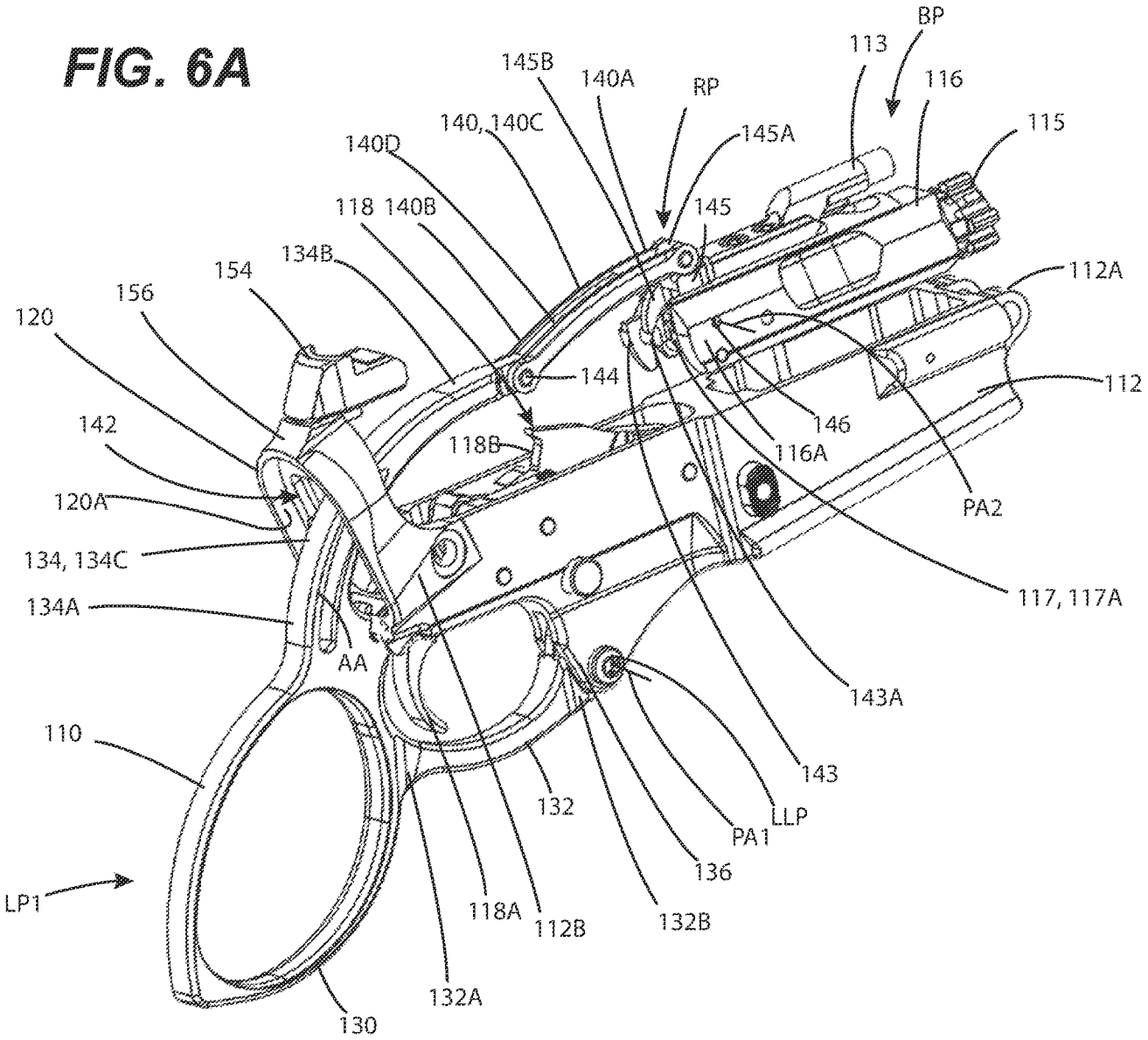
FIG. 6A is a first perspective view showing aspects of a lower receiver body, carrier group, linkage member, action-control lever arm and trigger assembly of the rifle shown in FIG. 1, with the action-control lever thereof in the battery-ready position.
Figure 6B:
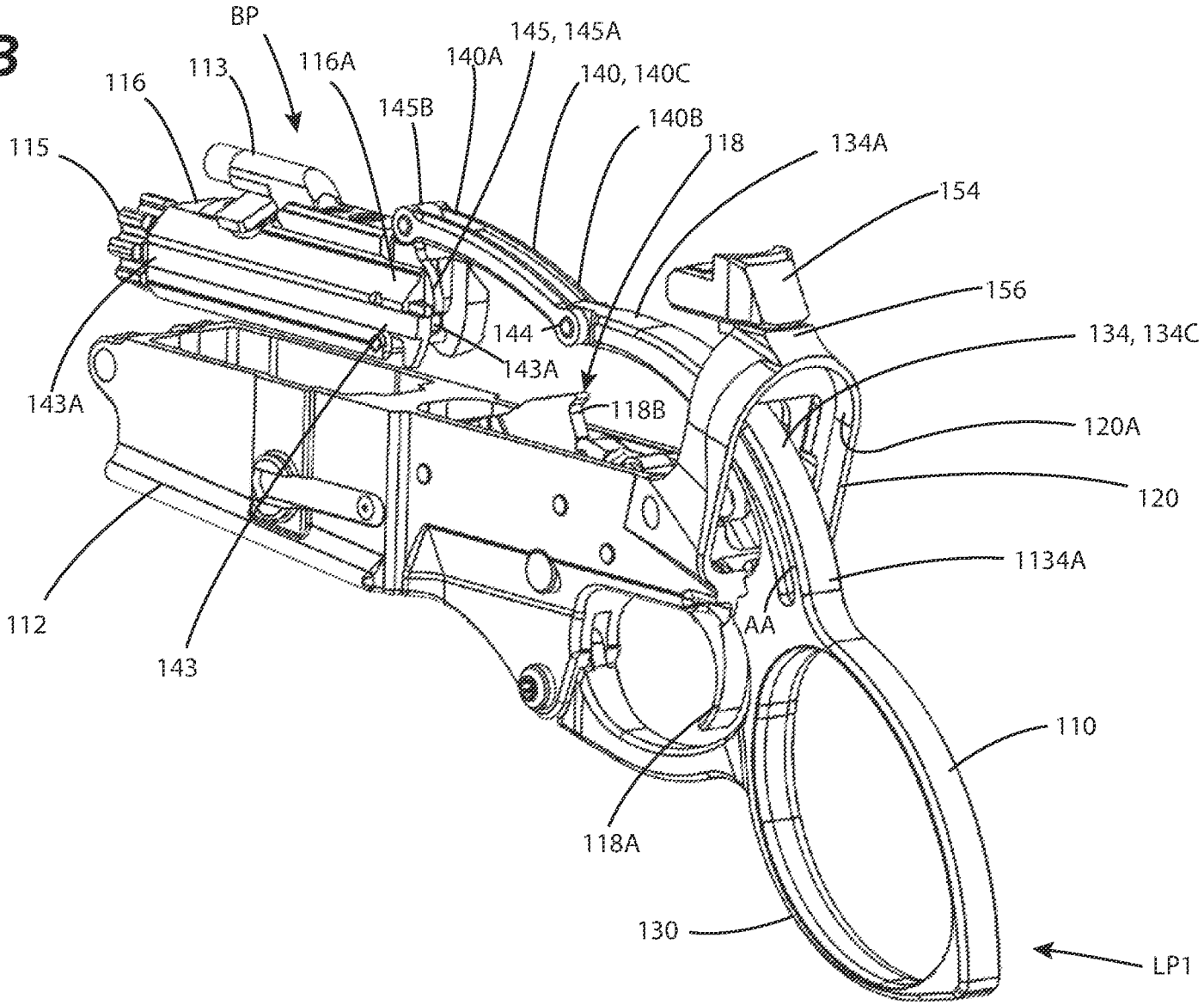
FIG. 6B is a second perspective view showing aspects of a lower receiver body, carrier group, linkage member, action-control lever arm and trigger assembly of the rifle shown in FIG. 1, with an action-control lever thereof in the battery-ready position.
Figure 7A:
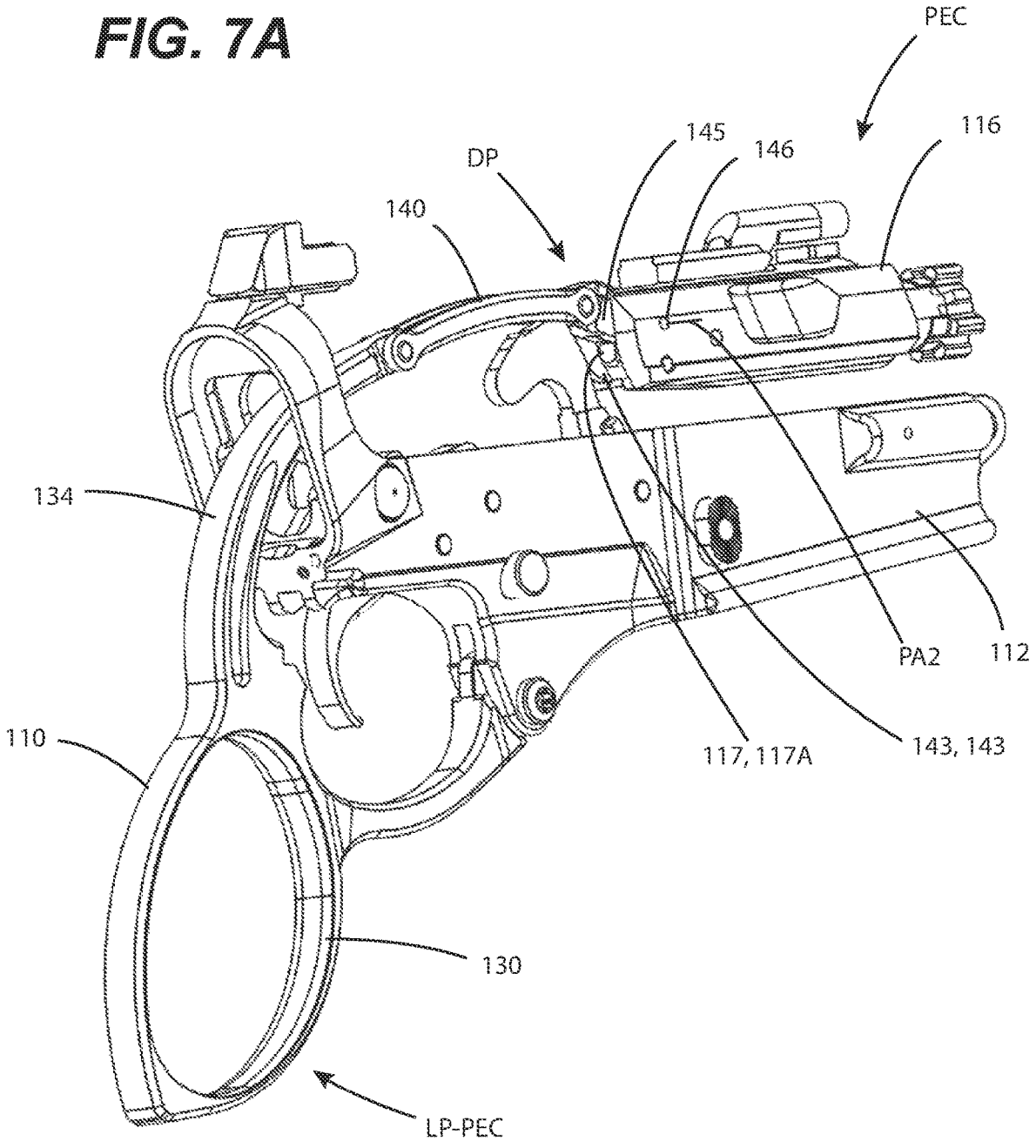
FIG. 7A is a first perspective view showing aspects of a lower receiver body, carrier group, linkage member, action-control lever arm and trigger assembly of the rifle shown in FIG. 1, with the action-control lever thereof in the primary extraction completed position.
Figure 7B:
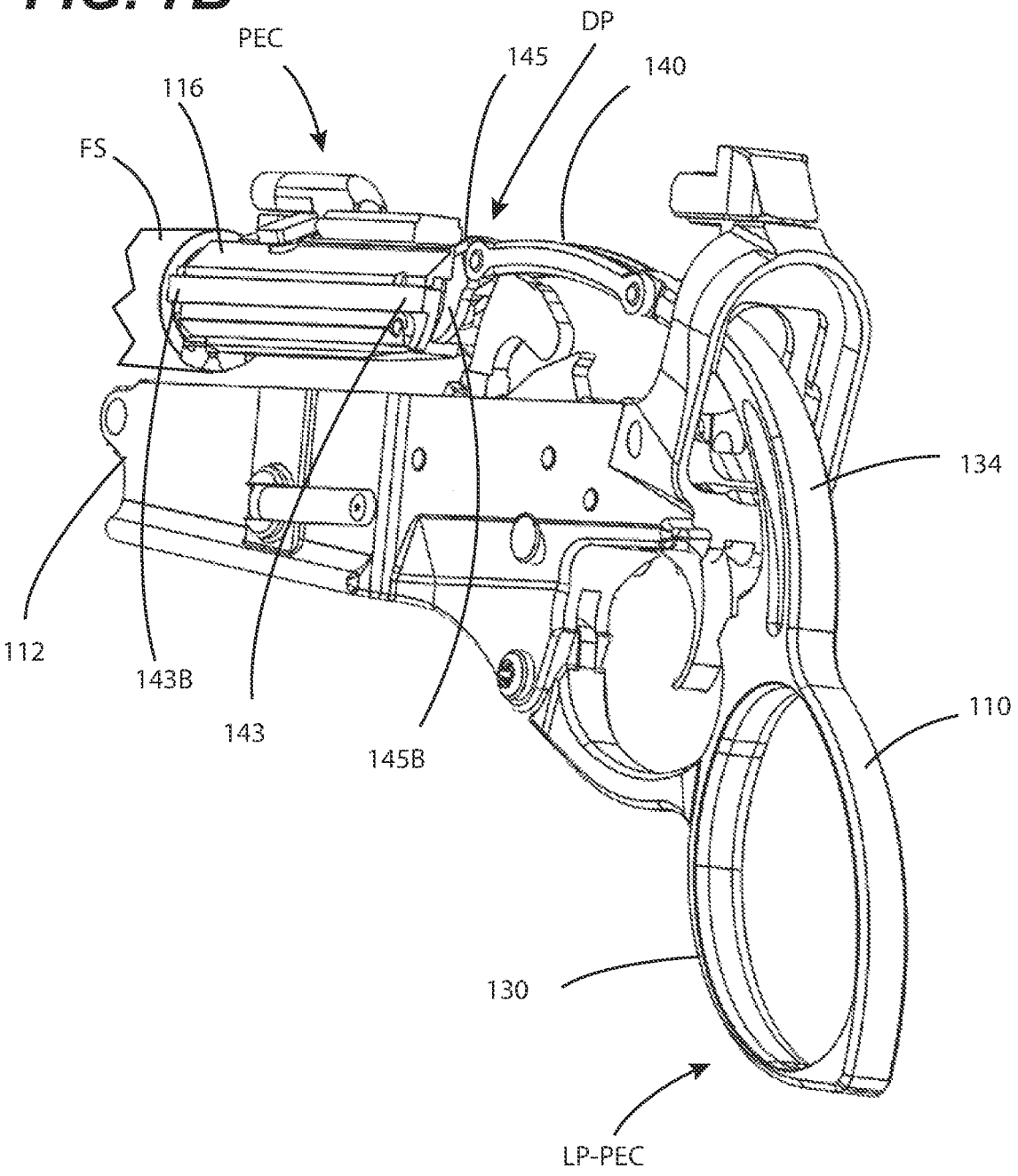
FIG. 7B is a second perspective view showing aspects of a lower receiver body, carrier group, linkage member, action-control lever arm and trigger assembly of the rifle shown in FIG. 1, with the action-control lever thereof in the primary extraction completed position.
Figure 8:
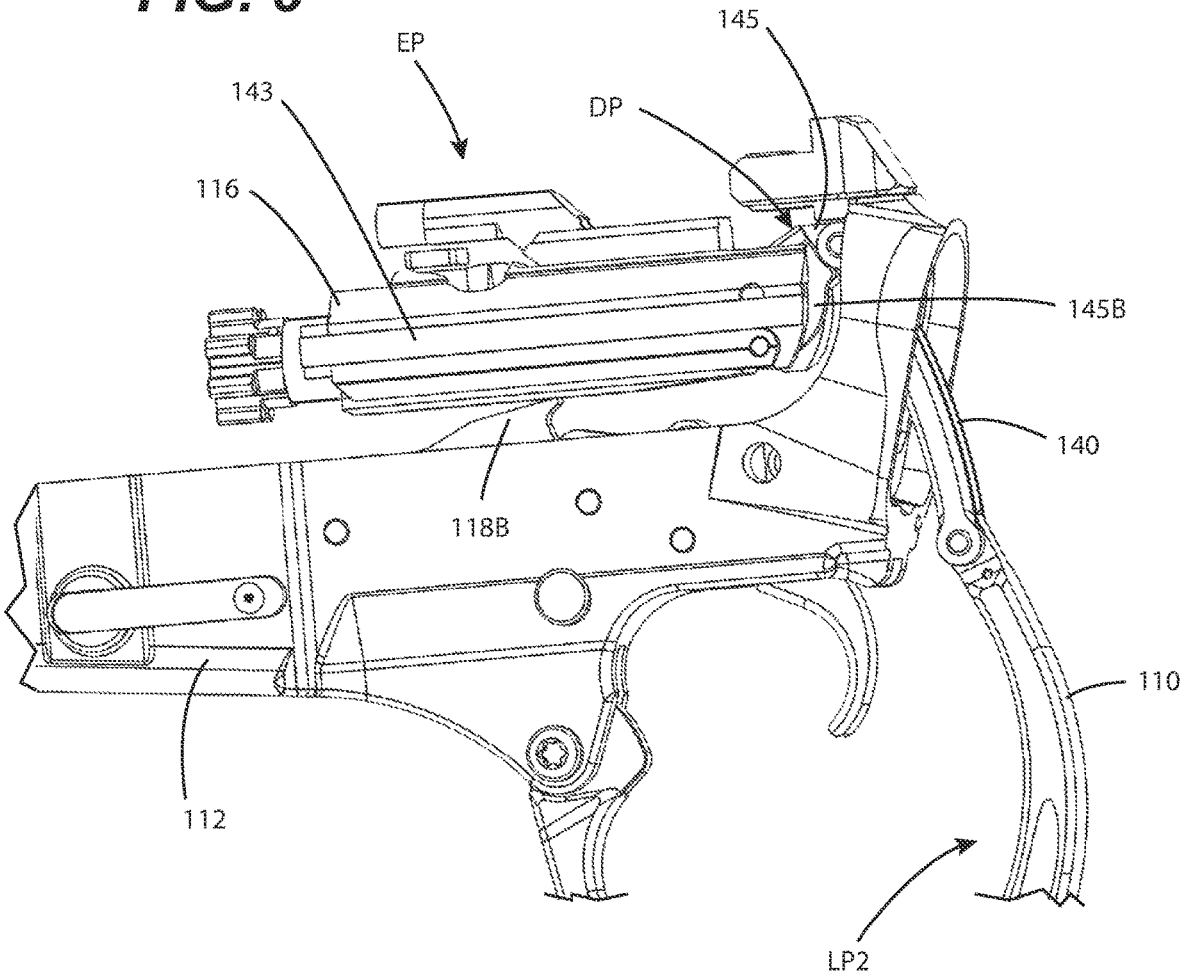
FIG. 8 is a third perspective view showing aspects of a lower receiver body, carrier group, linkage member, action-control lever arm and trigger assembly of the rifle shown in FIG. 1, with the action-control lever thereof in the cartridge-ejecting position (e.g., a fully-retracted position).

When used with a lower receiver body that is lever-action specific in accordance with the disclosures made herein, the aforementioned charging handle may be omitted from the firearm construct. Thus, there is no head portion of the charging handle to reside within the charging handle pocket 150 and no elongated member portion of the charging handle to reside within the charging handle passage 152. In preferred embodiments, a charging handle plug 154 (which may be part of the disclosed receiver system) is secured within the charging handle pocket 150 as a result of the lower and upper receivers 112, 114 being attached to (i.e., engaged with) each other, as best shown in FIGS. 5 and 9. The charging handle plug 154 serves the valuable purposes of limiting external contaminants from entering the firearm through the charging handle passage 152 and limiting gunshot residue during cartridge discharge from escaping to the atmosphere through the charging handle passage 152. The lower receiver body 112 may include a plug engagement body 156 having an engagement surface that engages a mating engagement surface of the charging handle plug 154 to bias the charging handle plug 154 into constrained engagement within the charging handle pocket 150 as a result of the lower and upper receivers 112, 114 being attached to each other. The plug engagement body 156 is preferably integral with the stock mounting flange 120.

Referring now to FIGS. 5, 12, 17, and 18, the receiver system 102 may further include a stock securement body 160. The stock securement body 160 serves to provide a mounting structure attached to the lower receiver body 112 to which a stock fastener 162 may attach for enabling the stock 108 to be fixedly secured to the lower receiver body 112. The stock securement body 160 is preferably attached to the stock mounting flange 120 in a selectively detachable manner, but in a manner in which it is fixedly secured when the stock 108 is fixedly secured to the lower receiver body 112.

The stock securement body 160 includes a first end portion 160A and a second end portion 160B. The first end portion 160A is configured for having the stock fastener 162 engaged therewith and the second end portion 160B is configured for engagement with the stock flange 120. In preferred embodiments, the first end portion 160A has an interlock (e.g., threaded) interface 164 that may be engaged with a mating interlock interface 166 of a stock fastener 162. The second end portion 160B has spaced-apart engagement shoulders 168. The stock mounting flange 120 includes opposing shoulder-receiving receptacles 170 formed by spaced apart wall segments of the stock mounting flange 120 within its central passage 142.

The spaced-apart engagement shoulders 168 and the opposing shoulder-receiving receptacles 170 are jointly configured for permitting each of the spaced-apart engagement shoulders 168 to be engaged within a respective one of the opposing shoulder-receiving receptacles 170 to inhibit unrestricted fore and aft movement of the stock securement body 160 relative to the stock mounting flange 120. For example, the opposing shoulder-receiving receptacles 170 have entry recesses that permit each engagement shoulders 168 to be engaged within the respective one of the opposing shoulder-receiving receptacles 170 by placing each of the spaced-apart engagement shoulders 168 into the respective one of the opposing shoulder-receiving receptacles 170 and then being moved vertically into a slotted portion of the respective one of the opposing shoulder-receiving receptacles 170 to thereby inhibit unrestricted fore and aft movement of the stock securement body 160 relative to the stock mounting flange 120.

The receiver engaging portion 108B of the stock 108 includes a stub 108C that has a mating fit within the stock receptacle 120A of the stock mounting flange 120. This mating fit (e.g., slip fit) fixedly positions the receiver engaging portion 108B of the stock 108 relative to the stock mounting flange 120 (i.e., limits up/down and side-to-side movement of the stub 108C within the stock receptacle 120A). The stock 108 preferably includes a passage in the receiver engaging portion 108B that receives the first end portion 160A of the stock securement body 160 (e.g., an elongated round bore having an inside diameter with a close-tolerance fit (e.g., not more than 0.050") with the outside diameter of the first end portion 160A of the stock securement body 160). Thus, fixed positioning of the receiver engaging portion 108B of the stock 108 relative to the stock receptacle 120A via engagement of the stock fastener 162 with the stock 108 and the stock securement body 160 limits vertical movement of the spaced-apart engagement shoulders 168 relative to the opposing shoulder-receiving receptacles 170 to thereby maintain each spaced-apart engagement shoulder 168 in engagement with the respective one of the opposing shoulder-receiving receptacles 170.

Figure 17:
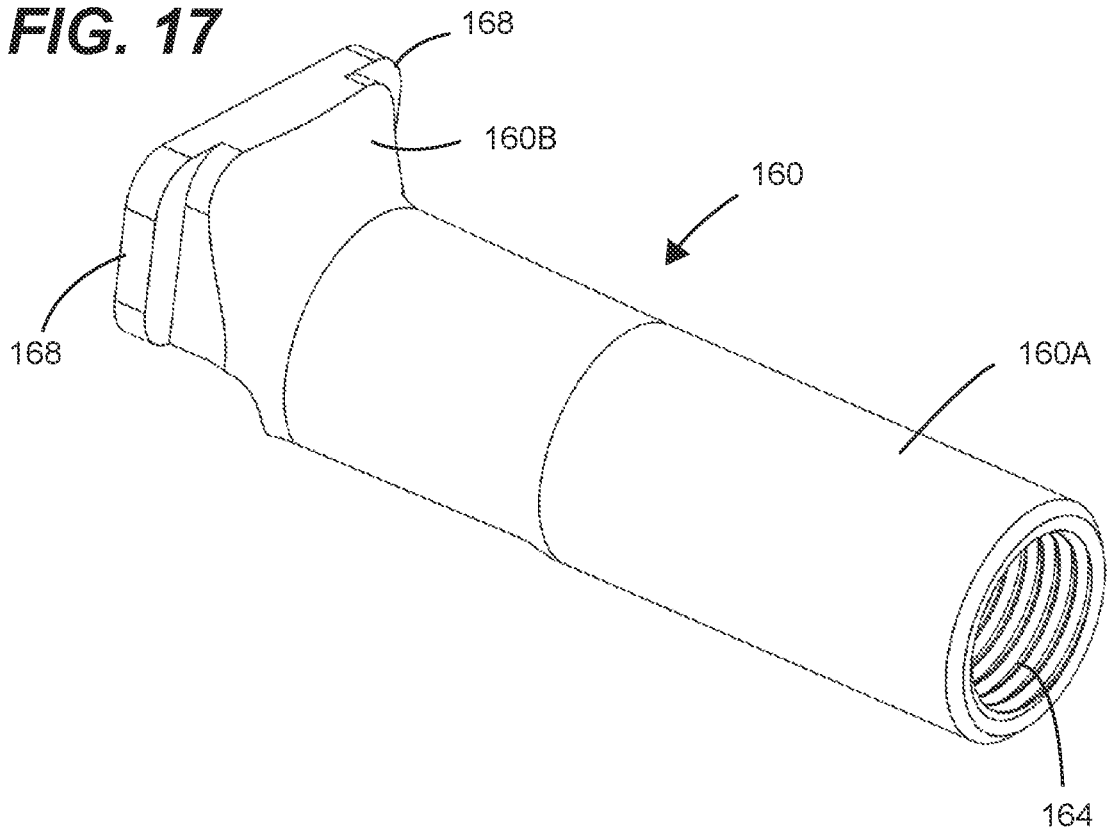
FIG. 17 is a first perspective view showing an accessory securement body of the rifle shown in FIG. 1.
Figure 18:
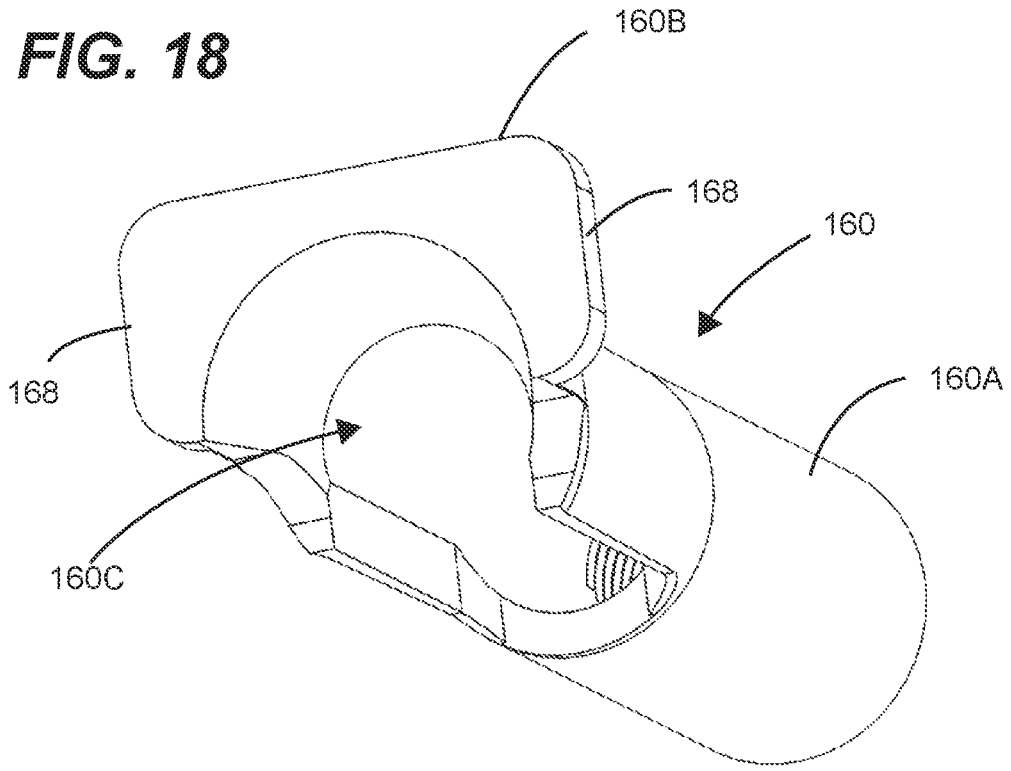
FIG. 18 is a second perspective view showing the accessory securement body of the rifle shown in FIG. 1.

In some embodiments, as shown in FIGS. 17 and 18, the stock securement body 160 may include an attachment arm passage 160C. The second attachment arm 134 of the action-control lever 110 extends through the attachment arm passage 160C and through the stock mounting flange 120 with the action-control lever 110 in the battery-ready position LP1. The linkage member 140 may extend through the attachment arm passage 160C and through the stock mounting flange 120 with the action-control lever 110 sufficiently displaced from the battery-ready position LP1 toward the cartridge-ejecting position LP2, with the action-control lever 110 in the cartridge-ejecting position LP2, or both.

Figure 13A:
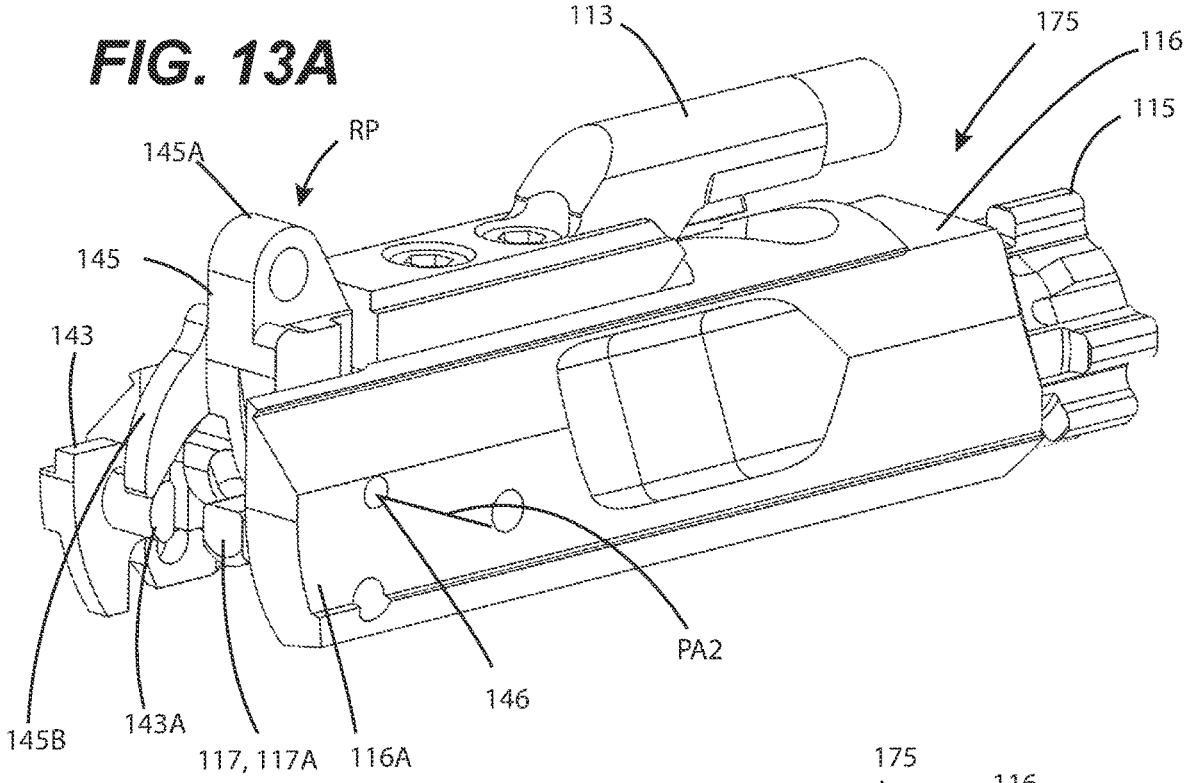
FIG. 13A is an enlarged perspective view of the bolt carrier movement mechanism of the rifle shown in FIG. 1.
Figure 13B:
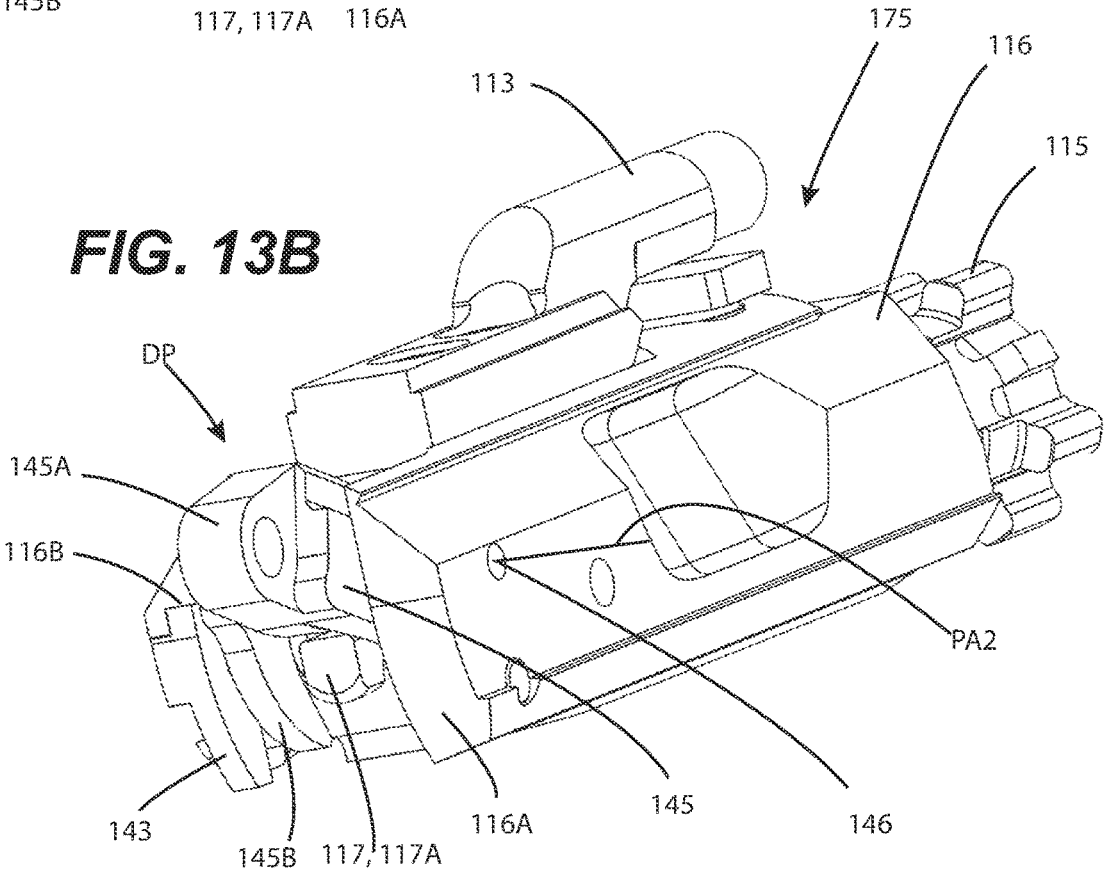
FIG. 13B is an enlarged perspective view of the bolt carrier movement mechanism of the rifle shown in FIG. 1.

Referring now to FIGS. 6A, 6B, 7A, 7B, 13A, 13B and 14, the bolt carrier movement mechanism of the rifle 100 (i.e., bolt carrier movement mechanism 175) is discussed. The bolt carrier movement mechanism 175 is a bolt carrier movement mechanism in accordance with a first embodiment of the disclosures made herein. The bolt carrier movement mechanism 175 includes the gas key 113, the bolt carrier 116, the linkage member 140 (i.e., an action control structure coupler), impingement body 143, and primary extraction leverage member 145 (i.e., an intermediate linkage member). In FIGS. 13A and 13B, the bolt 115 (not part of the bolt carrier movement mechanism 175) is shown for purposes of illustrating unlocking of the bolt 115 when the bolt carrier 116 is displaced over a primary extraction distance afforded by the bolt carrier movement mechanism 175. In some embodiments, the bolt carrier movement mechanism 175 may exclude the gas key 113, the linkage member 140 (i.e., an action control body coupler), or both.

Figure 14:
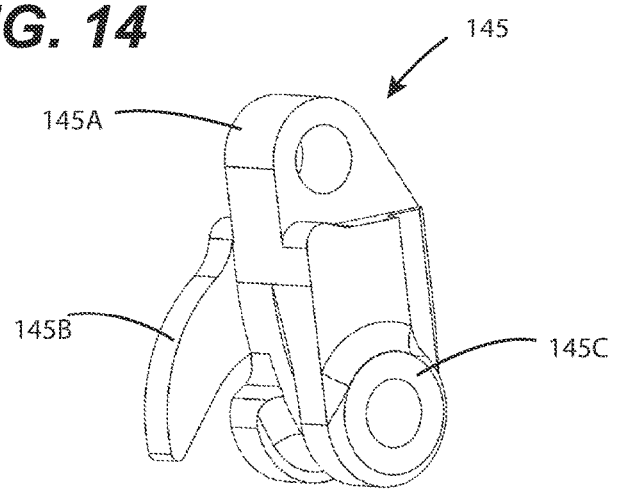
FIG. 14 is an enlarged perspective view of the primary extraction leverage member of the rifle shown in FIG. 1.

As best shown in FIG. 14, the primary extraction leverage member 145 includes a coupler mounting portion 145A, an impingement member portion 145B, and a bolt carrier mounting portion 145C. The primary extraction leverage member 145 is pivotably engaged at the bolt carrier mounting portion 145C with the rear end portion 116A of the bolt carrier 116. Such engagement enables the primary extraction leverage member 145 to pivot about a pivot axis PA2 extending through the bolt carrier mounting portion 145C and a pivot pin 146 (i.e., an embodiment of a pivot member) that pivotably attaches the primary extraction leverage member 145 to the bolt carrier 116 (i.e., an embodiment of a pivot structure enabling relative rotation between the primary extraction leverage member 145 and the bolt carrier 116). Such pivotable attachment may be achieved by any suitable and reliable means for enabling the required pivoting articulation between the primary extraction leverage member 145 and the bolt carrier 116. In some embodiments, the primary extraction leverage member 145 may be engaged with a different portion of the bolt carrier 116 other than its rear end portion 116A (e.g., to a central portion thereof).

The action-control lever 110 is pivotably coupled to the bolt carrier 116 through the linkage member 140 for enabling movement of the action-control lever 110 from the battery-ready position LP1 (FIGS. 1-3, 6A and 6B) to a primary extraction completed position LP-PEC (FIGS. 7A and 7B) to cause a corresponding movement of the primary extraction leverage member 145 from a fully retracted position RP to a fully displaced position DP. The fully retracted position RP and the fully displaced position DP are preferably defined by the primary extraction leverage member 145 contacting respective portions of the bolt carrier 116 for limiting rotation of the primary extraction leverage member 145 to being between the fully retracted position RP and the fully displaced position DP.

Rotation (i.e., translation) of the primary extraction leverage member 145 from the fully retracted position RP to the fully displaced position DP causes movement of the bolt carrier 116 from the battery position BP to a position where primary extraction of a cartridge within a chamber of the firearm 100 is complete (i.e., primary extraction completed position PEC). As discussed below in greater detail, bolt carrier movement mechanisms in accordance with the disclosures made herein beneficially exhibit increased primary extraction force capability for a given applied load on an action control structure (e.g., the action control lever 110) than when an action control structure is engaged with a bolt carrier without the benefit of a leverage providing-structure. This increased primary extraction force capability is particularly beneficial for firearms having a manually-energized bolt carrier movement mechanisms and a rotating bolt chambering arrangement.

As best shown in FIG. 13A, the impingement member portion 145B of the primary extraction leverage member 145 (i.e., an impingement member) engages a mating impingement member 143A of the impingement body 143. The mating impingement member 143A of the impingement body 143 has a surface upon which a mating surface (e.g., a contoured camming surface) of the impingement member portion 145B bears (i.e., impinges) during rotation from the fully retracted position RP to the fully displaced position DP. The impingement body 143 is slidably mounted within a mating channel 116B of the bolt carrier 116 and a front end portion 143B of the impingement body 143 bears against a fixed structure FS of the firearm 100 (FIG. 7B) that is made from a sufficiently hardened material—e.g., a hardened barrel extension, a hardened steel insert within the upper receiver, or the like. Thus, the rotation of the primary extraction leverage member 145 from the fully retracted position RP to the fully displaced position DP results in rearward movement of the bolt carrier 116 in view of the impingement body 143 being inhibited from forward motion relative to the upper receiver body 114 and other components immovably attached thereto. In response to the primary extraction leverage member 145 being rotated from the fully retracted position RP to the fully displaced position DP, the bolt carrier 116 is urged rearward from the battery position BP to the primary extraction completed position PEC.

In the primary extraction completed position PEC, the bolt carrier 116 has translated from the battery position BP by a distance defined by physical parameters of the bolt carrier movement mechanism 175. These physical parameters of the bolt carrier movement mechanism 175 define a primary extraction force multiplication factor for the bolt carrier movement mechanism 175. More specifically, for a given force applied to the primary extraction leverage member 145 for causing its rotation from the fully retracted position RP to the fully displaced position DP, the bolt carrier movement mechanism 175 results in multiplication of that force onto the bolt carrier 116.

As a skilled person will appreciate in view of the disclosures made herein, force multiplication provided by the bolt carrier movement mechanism 175 is a function of at least a distance from the pivot axis PA2 of the primary extraction leverage member 145 to a point of attachment of the primary extraction leverage member 145 to the linkage member 140 (i.e., the action control structure coupler) and a distance from the pivot axis PA2 of the primary extraction leverage member 145 to a point of contact of the impingement member 145B and mating impingement member 143A of the impingement body 143. In some embodiments, the physical parameters of the bolt carrier movement mechanism 175 provide a force multiplication factor (i.e., the force delivered onto the bolt carrier 116 relative to force delivered onto the primary extraction leverage member 145 for causing its rotation about the pivot axis PA2 of the primary extraction leverage member 145) of at least about 2.0. In some preferred embodiments of the bolt carrier movement mechanism 175 (e.g., the impingement member portion 145B being located between the coupler mounting portion 145A and the bolt carrier mounting portion 145C), the physical parameters the bolt carrier movement mechanism 175 provide a force multiplication factor of at least about 3.5. The limit of force multiplication factor may be limited by the available internal space within a receiver system.

Referring now to FIGS. 19A-22, a bolt carrier movement mechanism in accordance with a second embodiment of the disclosures made herein is disclosed (i.e., bolt carrier movement mechanism 200). Although the bolt carrier movement mechanism 200 is shown as being implemented in a lever action manner, a skilled person will appreciate in view of the disclosures made herein that the bolt carrier movement mechanism 200 may be implemented in different manners as needed for a particular style of firearm. For example, the bolt carrier movement mechanism 200 may be suitably implemented for pump-action style firearms, charging handle style firearms and the like.

The bolt carrier movement mechanism 200 includes a gas key 213, a bolt carrier 216, a linkage member 240, an impingement body 243, and a primary extraction leverage member 245. The action control lever 210 and the bolt 215 (not parts of the bolt carrier movement mechanism 200) are shown for purposes of illustrating unlocking of the bolt 215 when the action control lever 210 is moved from the battery ready position LP1 (FIGS. 19A and 19B) to the primary extraction completed position LP-PEC (FIGS. 20A and 20B) for causing the bolt carrier 216 to be urged rearward from the battery position BP to the primary extraction completed position PEC. In the primary extraction completed position PEC, the bolt carrier 216 is displaced over a primary extraction distance afforded by movement of the primary extraction leverage member 245 from a retracted position RP (FIGS. 19A, 19B) to a displaced position DP (FIGS. 20A, 20B). In some other embodiments, the bolt carrier movement mechanism 200 may exclude the gas key 213, the linkage member 240, or both.

Figure 19A:
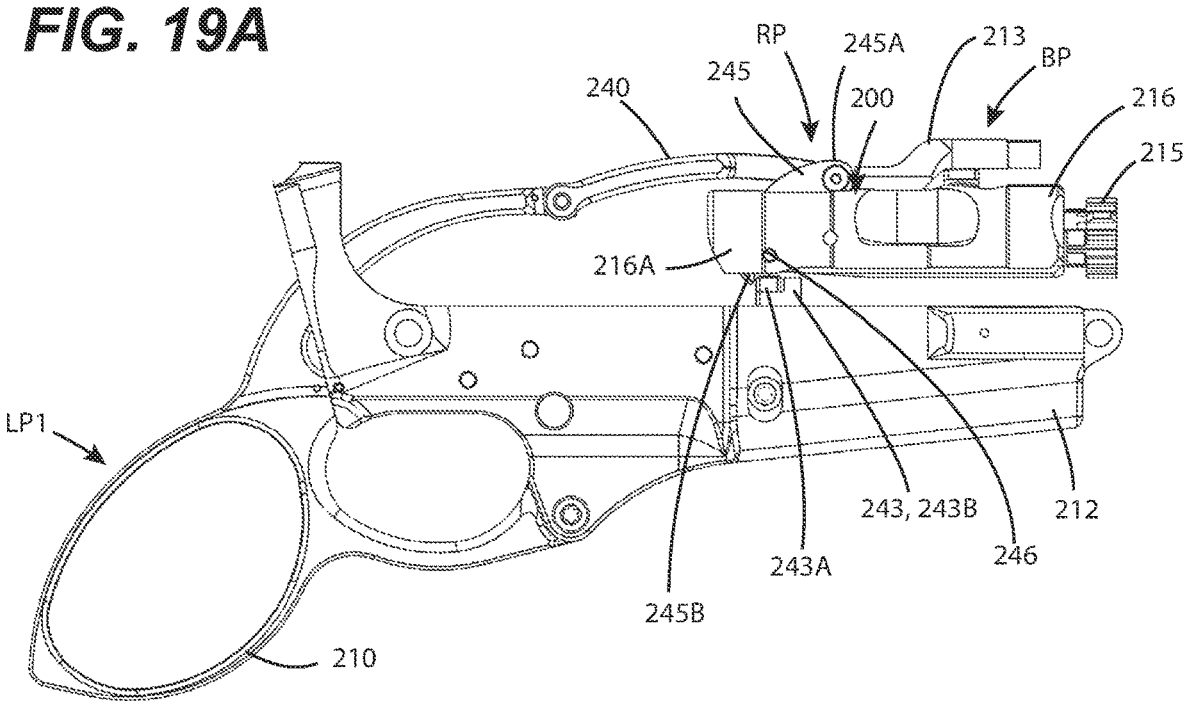
FIG. 19A is a side view of a lower receiver, a bolt carrier group, and an action lever assembly of a firearm having a bolt carrier movement mechanism in accordance with a second embodiment of the disclosures made herein, with an action-control lever thereof in the battery-ready position.
Figure 19B:
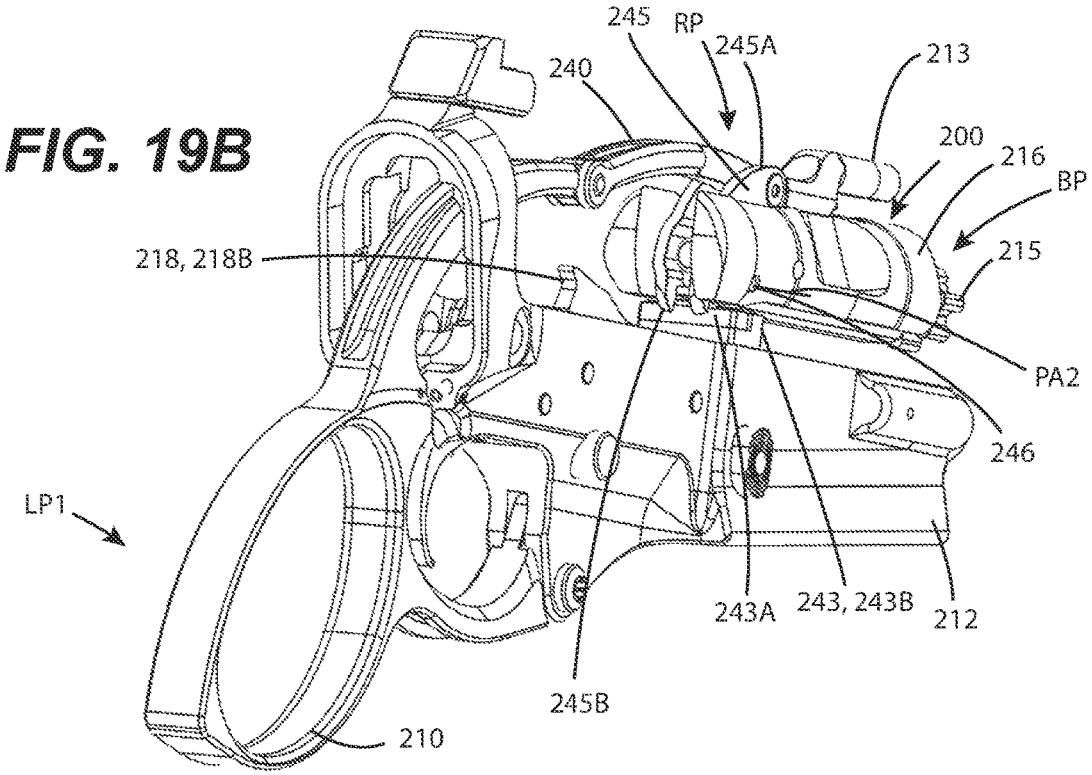
FIG. 19B is a perspective view of the firearm components shown in FIG. 19A, with the action-control lever thereof in the battery-ready position.
Figure 20A:
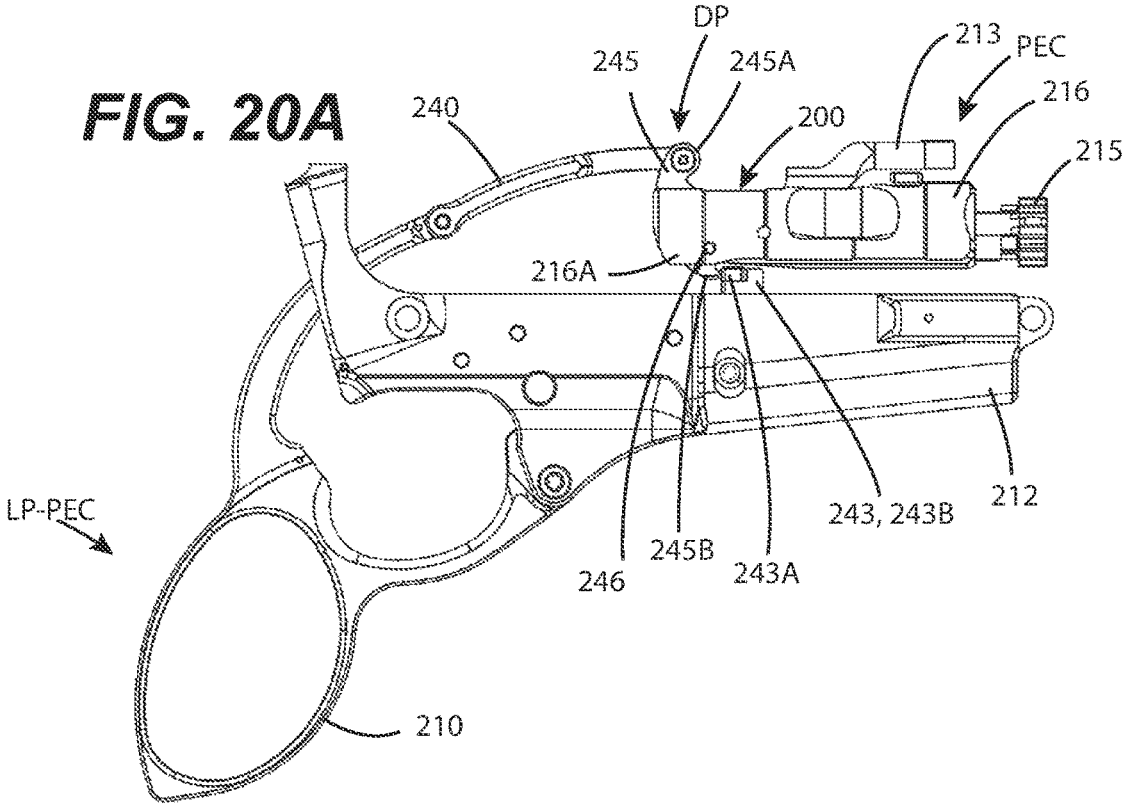
FIG. 20A is a side view of the firearm components shown in FIG. 19A, with the action-control lever thereof in the primary extraction completed position.
Figure 20B:
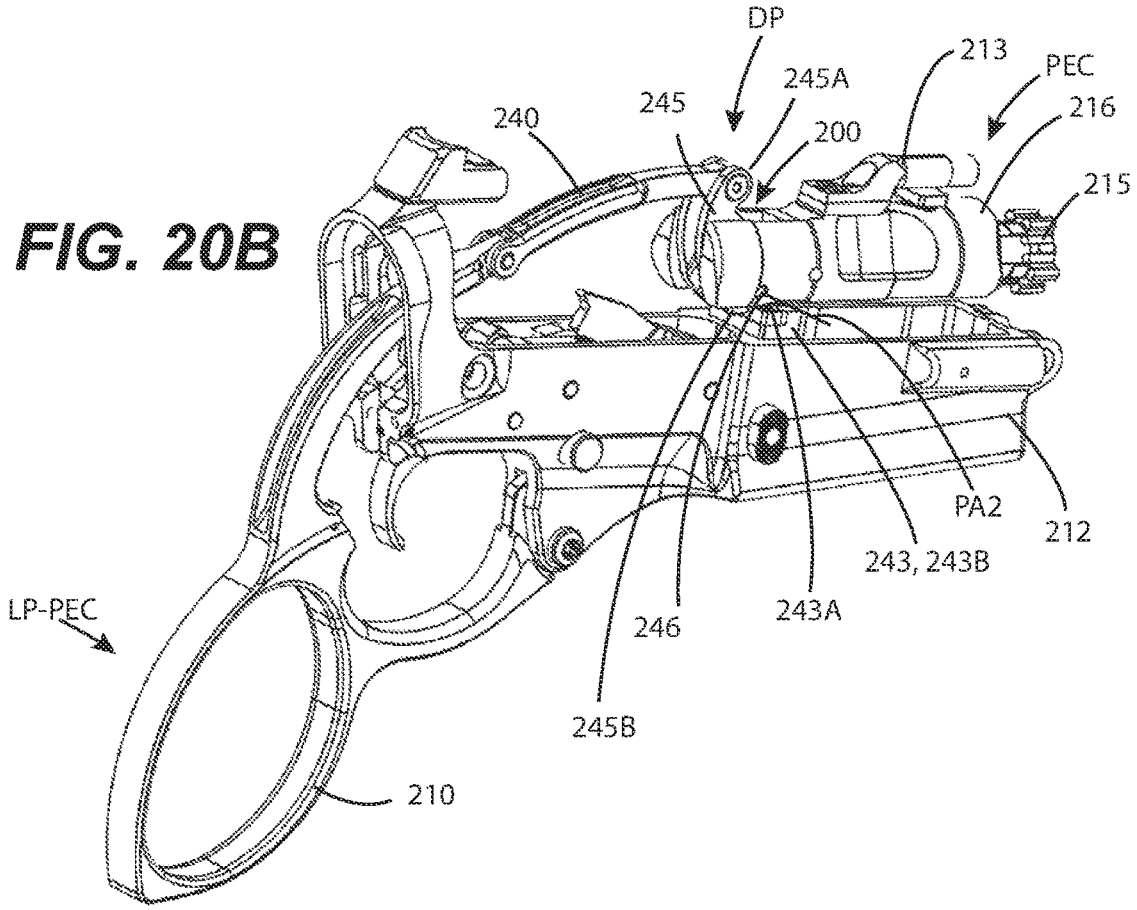
FIG. 20B is a perspective view of the firearm components shown in FIG. 19A, with the action-control lever thereof in the primary extraction completed position.
Figure 21:
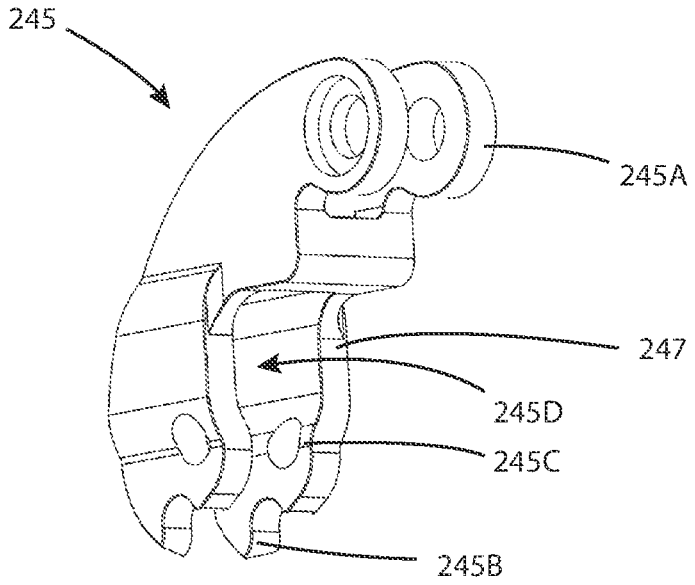
FIG. 21 is a perspective view showing a primary extraction leverage member of the bolt carrier movement mechanism shown in FIGS. 19A, 19B, 20A, and 20B.
Figure 22:
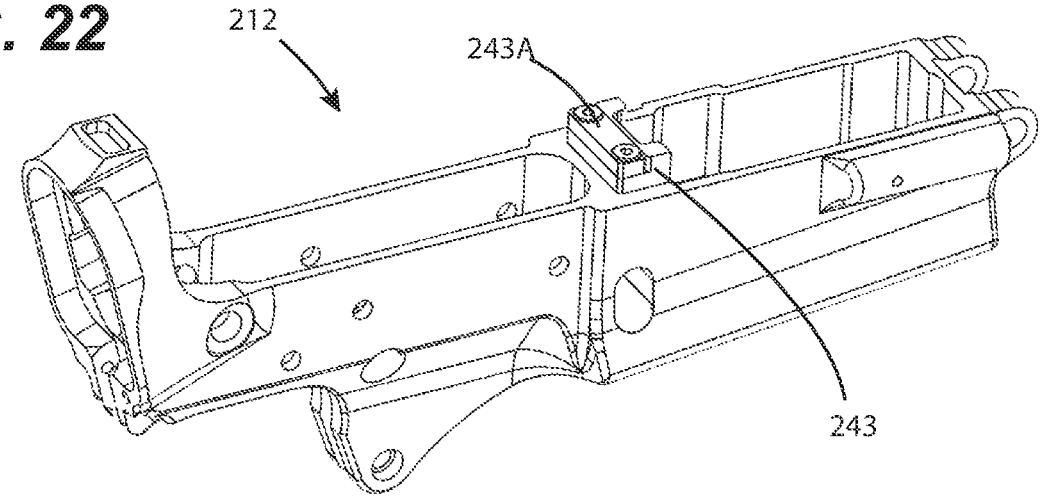
FIG. 22 is a perspective view showing the lower receiver of the bolt carrier movement mechanism shown in FIGS. 19A, 19B, 20A, and 20B.

As shown in FIGS. 19A, 19B, 20A, 20B, and 21, the primary extraction leverage member 245 includes a coupler mounting portion 245A, an impingement member portion 245B, and a bolt carrier mounting portion 245C. The primary extraction leverage member 245 is pivotably engaged at its bolt carrier mounting portion 245C with the rear end portion 216A of the bolt carrier 216 for enabling the primary extraction leverage member 245 to pivot about a pivot axis PA2 extending through the bolt carrier mounting portion 245C and a pivot pin 246 that pivotably attaches the primary extraction leverage member 245 to the bolt carrier 216. In some embodiments, the primary extraction leverage member 245 may be engaged with a different portion of the bolt carrier other than its rear end portion 216A (e.g., to a central portion thereof). As best shown in FIG. 21, a lower end portion 247 of the primary extraction leverage member 245 includes spaced apart impingement members 245B (i.e., impingement member portions of the primary extraction leverage member 245), spaced apart bolt carrier mounting portions 245C, and a firing pin access passage 245D extending between the spaced apart impingement members 245B and the spaced apart bolt carrier mounting portions 245C. As best shown in FIG. 19B, the firing pin access passage 245D provides for access to the head 117A of the firing pin 117 by a hammer 218B of a trigger group 218.

The action-control lever 210 is pivotably coupled to the bolt carrier 216 through the linkage member 240 for enabling movement of the action-control lever 210 from the battery-ready position LP1 (FIGS. 19A, 19B) to a primary extraction completed position LP-PEC (FIGS. 20A, 20B) to cause a corresponding movement of the primary extraction leverage member 245 from a fully retracted position RP to a fully displaced position DP. The fully retracted position RP and the fully displaced position DP are preferably defined by the primary extraction leverage member 245 contacting respective portions of the bolt carrier 216 for limiting rotation of the primary extraction leverage member 245 to being between the fully retracted position RP and the fully displaced position DP.

Rotation (i.e., translation) of the primary extraction leverage member 245 from the fully retracted position RP to the fully displaced position DP causes movement of the bolt carrier 216 from the battery position BP to a position where primary extraction of a cartridge within a chamber of a firearm comprising the bolt carrier movement mechanism 200 is complete (i.e., primary extraction completed position PEC). As discussed below in greater detail, bolt carrier movement mechanisms in accordance with the disclosures made herein beneficially exhibit increased primary extraction force capability for a given applied load on an action control structure (e.g., the action control lever 210) than when an action control structure is engaged with a bolt carrier without the benefit of a leverage providing structure such as bolt carrier movement mechanisms in accordance with the disclosures made herein. This increased primary extraction force capability is particularly beneficial for firearms having a manually-energized bolt carrier movement mechanisms and a rotating bolt chambering arrangement.

As best shown in FIGS. 19A, 19B, 20A, 20B, 21 and 22, the impingement member portion 245B of the primary extraction leverage member 245 (i.e., an impingement member) engages a mating impingement member 243A of the impingement body 243. The mating impingement member 243A of the impingement body 243 has a surface upon which the impingement member portion 245B bears (i.e., impinges) during rotation from the fully retracted position RP to the fully displaced position DP. Preferably, the mating impingement member 243A of the impingement body 243 is made from a sufficiently hardened material—e.g., a hardened steel barrel extension, a hardened steel insert within the upper receiver, or the like. As shown, the impingement body 243 may be integral with the lower receiver 212. In some embodiments (as shown), a base portion 243B of the impingement body 243 may be a unitarily-formed component of the lower receiver 212 and the mating impingement member 243A is attached to the base portion 243B. In some other embodiments, the mating impingement member 243A of the impingement body 243 and the base portion 243B of the impingement body 243 may be a unitarily-formed discrete component and the lower receiver 212 may have a receptacle or other feature for enabling the impingement body 243 to be fixedly engaged therewith. Thus, contact of the spaced apart impingement members 245B with the mating impingement member 243A of the impingement body 243 during rotation of the primary extraction leverage member 245 from the fully retracted position RP to the fully displaced position DP results in rearward movement of the bolt carrier 216 in view of the impingement body 243 being inhibited from forward motion relative to an upper receiver body mated to the lower receiver body 212 (e.g., the upper receiver body 114 discussed above). The resulting action of the primary extraction leverage member 245 being rotated from the fully retracted position RP to the fully displaced position DP is the bolt carrier 216 being urged rearward from the battery position BP to the primary extraction completed position PEC.

In the primary extraction completed position PEC, the bolt carrier 216 has translated from the battery position BP by a distance defined by physical parameters the bolt carrier movement mechanism 200. These physical parameters the bolt carrier movement mechanism 200 define a primary extraction force multiplication factor for the bolt carrier movement mechanism 200. More specifically, for a given force applied to the primary extraction leverage member 245 for causing its rotation from the fully retracted position RP to the fully displaced position DP, the bolt carrier movement mechanism 200 results in multiplication of that force onto the bolt carrier 216.

As a skilled person will appreciate in view of the disclosures made herein, force multiplication provided by the bolt carrier movement mechanism 200 is a function of at least a distance from the pivot axis PA2 of the primary extraction leverage member 245 to a point of attachment of the primary extraction leverage member 245 to the linkage member 240 (i.e., the action control structure coupler) and a distance from the pivot axis PA2 of the primary extraction leverage member 245 to a point of contact of the impingement member 245B and mating impingement member 243A of the impingement body 243. In some embodiments, the physical parameters of the bolt carrier movement mechanism 200 provide a force multiplication factor (i.e., the force delivered onto the bolt carrier 216 relative to force delivered onto the primary extraction leverage member 245 for causing its rotation about the pivot axis PA2 of the primary extraction leverage member 245) of at least about 2.0. In some preferred embodiments of the bolt carrier movement mechanism 200, the physical parameters the bolt carrier movement mechanism 200 provide a force multiplication factor of at least about 3.5.

Figure 23:
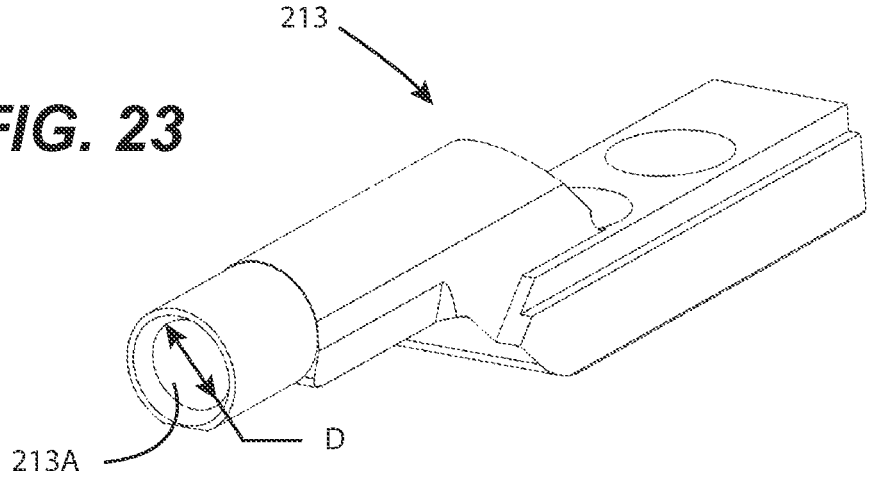
FIG. 23 is a perspective view showing a gas key configured for use with certain bolt carrier movement mechanism configured in accordance with one or more embodiments of the disclosures made herein.

Referring now to FIG. 23, the gas key 213 (i.e., a gas key in accordance with one or more embodiments of the disclosures made herein) is discussed. The gas key 213 is adapted for conversion of a firearm having an OEM configuration in which the bolt carrier is gas-driven via gas delivered from a gas tube at a distal end of the barrel to a gas key mounted on a bolt carrier of the firearm to a firearm configuration where the bolt carrier group is manually-energized such as via a bolt carrier movement mechanism in accordance with one or more embodiments of the disclosures made herein. Specifically, the gas key 213 has a gas tube cavity 213A with an inside diameter D that is larger than that of an original equipment manufacturer (OEM) gas key of a firearm for which the firearm bolt carrier movement mechanism is adapted for used. The inside diameter D is specified to inhibit gas delivered via the gas tube into the gas tube cavity 213A from being able to generate sufficient pressure within the gas tube cavity 213A for forcibly moving the bolt carrier to initiate the onset of a typical bolt cycling action. To this end, the inside diameter D is dimensioned to provide a gap between the inside diameter D of the gas key 213 and the outside diameter of the gas tube thereby permitting bypassing of gas between the gas tube cavity 213A and an end portion of a gas tube disposed within the gas tube cavity 213A.

Such gas-energized cycling action may interfere with and potentially cause an unsafe operation and implementation of manually-energized bolt carrier movement mechanisms in accordance with the disclosures made herein. The gas key 113 discussed above may have the same or functionally equivalent configuration as the gas key 213. In view of the disclosures made herein, a skilled person will appreciate other gas key configurations and/or associated bolt carrier interior space configurations (e.g., ports, flutes, passages, shapes, vanes, channels, orifices, interior space volumes, and the like) to inhibit gas delivered via a gas tube into a gas tube receiving space of a gas key and/or an associated bolt carrier interior space from being able to generate sufficient pressure therein sufficient for forcibly moving the bolt carrier to initiate the onset of a typical bolt cycling action. A gas key in accordance with embodiments of the disclosures made herein may omit a traditional passage for routing gas into the bolt carrier.

Figure 24:
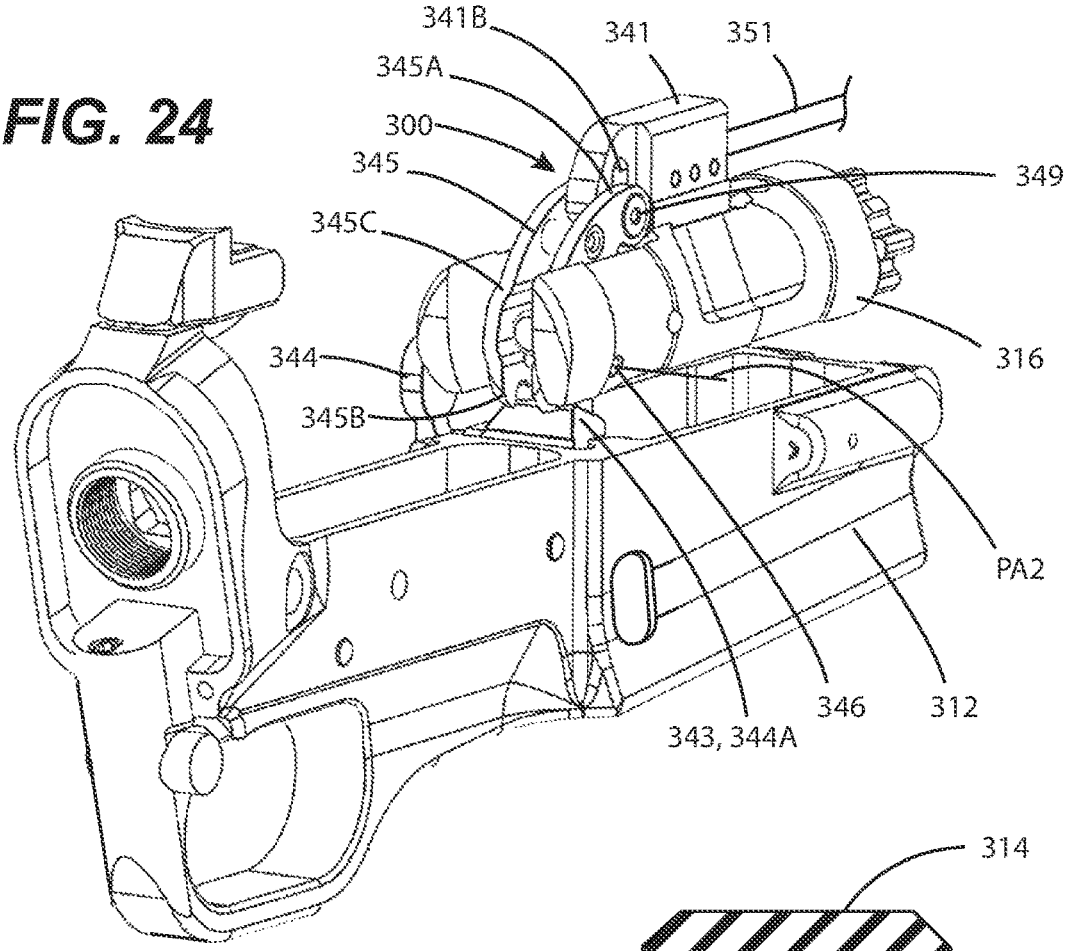
FIG. 24 is a perspective view of a lower receiver and a bolt carrier group of a firearm having a bolt carrier movement mechanism in accordance with a third embodiment of the disclosures made herein.
Figure 25:
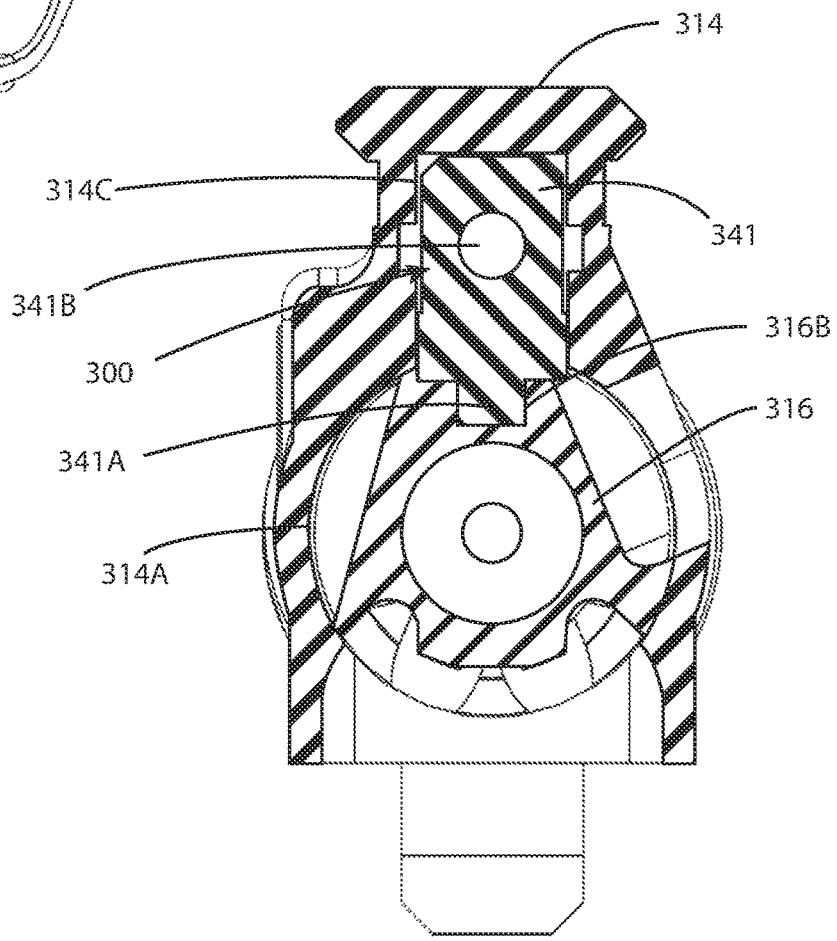
FIG. 25 is a cross-sectional view showing aspects of the lower receiver and the bolt carrier group shown in FIG. 24.

Referring now to FIGS. 24 and 25, a bolt carrier movement mechanism in accordance with a third embodiment of the disclosures made herein is discussed (bolt carrier movement mechanism 300). The bolt carrier movement mechanism 300 includes a bolt carrier 316, an action control structure coupler 341, an impingement body 343, and a primary extraction leverage member 345. The bolt carrier 316 and the primary extraction leverage member 345 may be substantially the same or identical to, respectively, the bolt carrier 216 and the primary extraction leverage member 245 disclosed above. Accordingly, the above disclosed structural and operational details as to the bolt carrier 216 and the primary extraction leverage member 245 are applicable to the bolt carrier 316 and the primary extraction leverage member 345.

The bolt carrier 316 is slidable engaged within a central bore 314A of an upper receiver 314. The primary extraction leverage member 345 is pivotably attached to the bolt carrier 316 (e.g., a rear end portion thereof) by a pivot pin 346. Such pivotable attachment may be achieved by any suitable means for enabling the required pivoting articulation between the primary extraction leverage member 345 and the bolt carrier 316. The action control structure coupler 341 may be pivotably attached (i.e., engaged) with a coupler mounting portion 345C of the primary extraction leverage member 345 by a pivot pin 349 that extends through an elongated slot 341B of the action control structure coupler 341. Such pivotable attachment may be achieved by any suitable means for enabling the required pivoting articulation between the primary extraction leverage member 345 and the action control structure coupler 341. As shown in FIG. 25, an upper portion of the action control structure coupler 341 is slidably disposed within a gas key passage 314C of the upper receiver 314.

Figure 26:
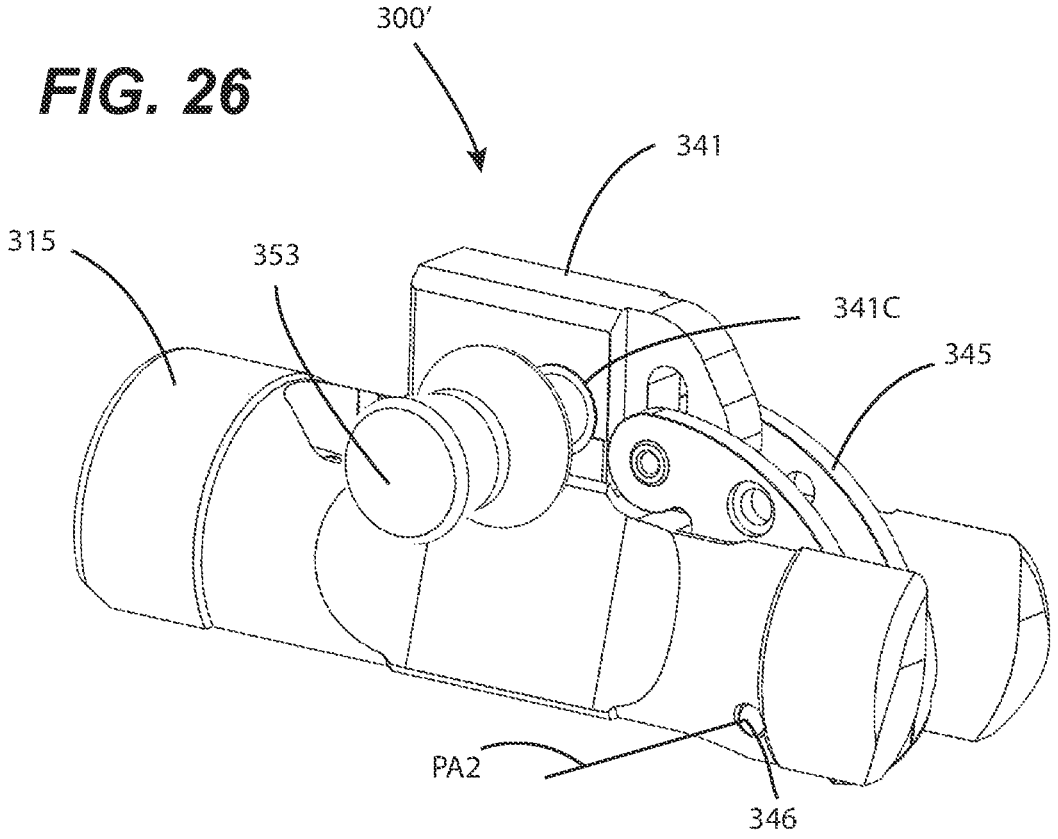
FIG. 26 is a perspective view of a bolt carrier movement mechanism in accordance with a fourth embodiment of the disclosures made herein.

The bolt carrier movement mechanism 300 is configured for use with firearms having a bolt action relying upon axial translation of a respective action control structure thereof. Examples of such axial translation of a respective action control structure include the operating rod of a pump-action rifle (e.g., the operating rod 351 of the bolt carrier movement mechanism 300 shown in FIG. 24), a side-mounted charging handle of a straight-pull bolt action rifle (e.g., the side-mounted charging knob 353 of the bolt carrier movement mechanism 300' shown in FIG. 26), or the like. To this end, the action control structure coupler 341 may be adapted for having an elongated member such as, for example, an operating rod engaged therewith at an end face thereof (e.g., a first mounting feature 341B within a front face of the action control structure coupler 341, as shown in FIG. 25), may be adapted for having a hand-gripping body such as a charging handle/knob engaged with a side face thereof (e.g., a second mounting feature 341C within a side face of the action control structure coupler 341, as shown in FIG. 26), or may be otherwise suitably adapted for having an action control structure engaged fixedly therewith.

The action control structure coupler 341 includes a guide member 341A that is slidable engaged within a channel 316B of the bolt carrier 316. The channel 316B and the guide member 341A are jointly configured (e.g., lengths and positions thereof) to permit axial translation of the action control structure coupler 341 relative to the bolt carrier 316 to cause corresponding movement of the primary extraction leverage member 345 between the fully retracted position RP thereof and the fully displaced position DP thereof. The guide member 341A being slidable engaged within the channel 316B of the bolt carrier 316 in combination with the upper portion of the action control structure coupler 341 being slidably disposed within the gas key passage 314C of the upper receiver 314 provide anti-rotation functionality for the bolt carrier 316.

Advantageously, the impingement body 343 may be integral with a bolt catch 344 of a firearm comprising the bolt carrier movement mechanism 300. In this regard, as shown in FIG. 24, a bolt engaging portion 344A of the bolt catch 344 may be the impingement body 343 upon which the impingement members 345B of the primary extraction leverage member 345 impinge to exert primary extraction force. Accordingly, in one or more embodiments, an OEM lower receiver used in conventional AR-15 platform rifles may be suitable for used with a bolt carrier movement mechanism in accordance with one or more embodiments of the disclosures made herein.

Figure 27A:
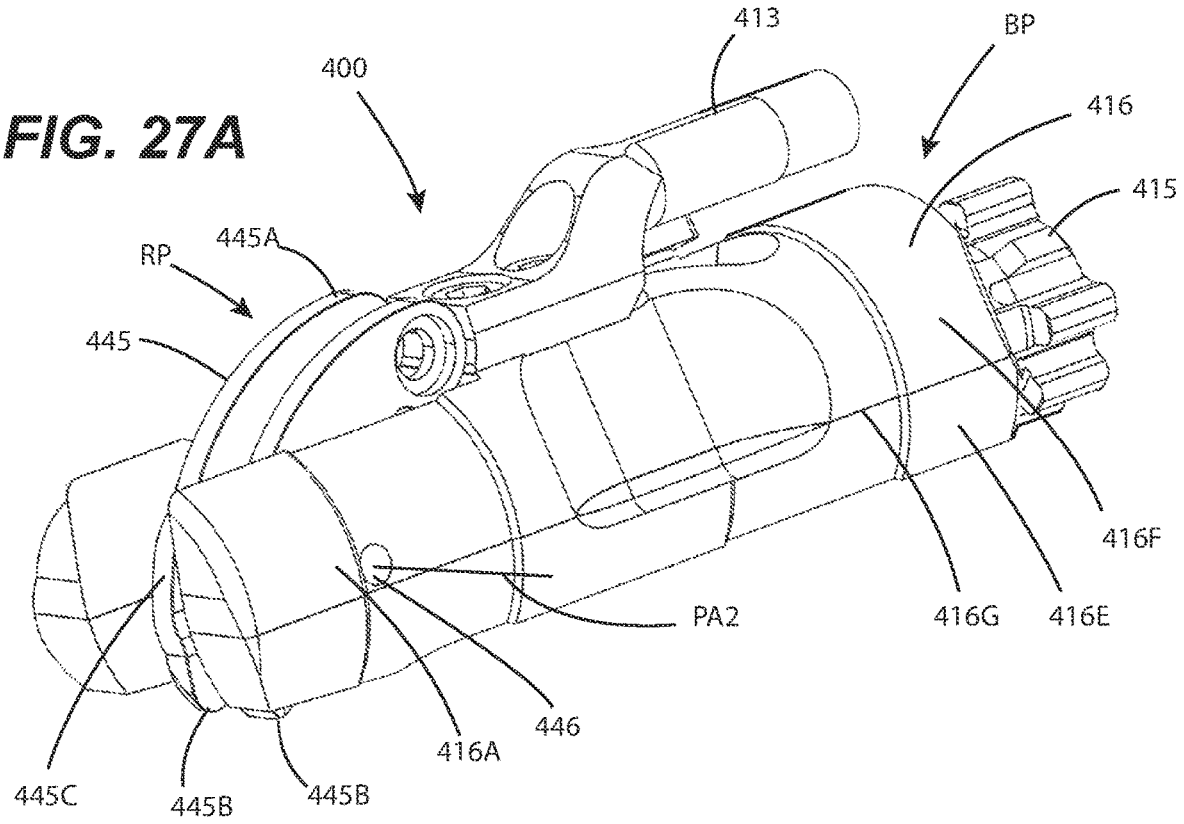
FIG. 27A is a perspective view showing a bolt carrier group of a bolt carrier movement mechanism in accordance with a fourth embodiment of the disclosures made herein, where the bolt carrier group is in a battery configuration.
Figure 27B:
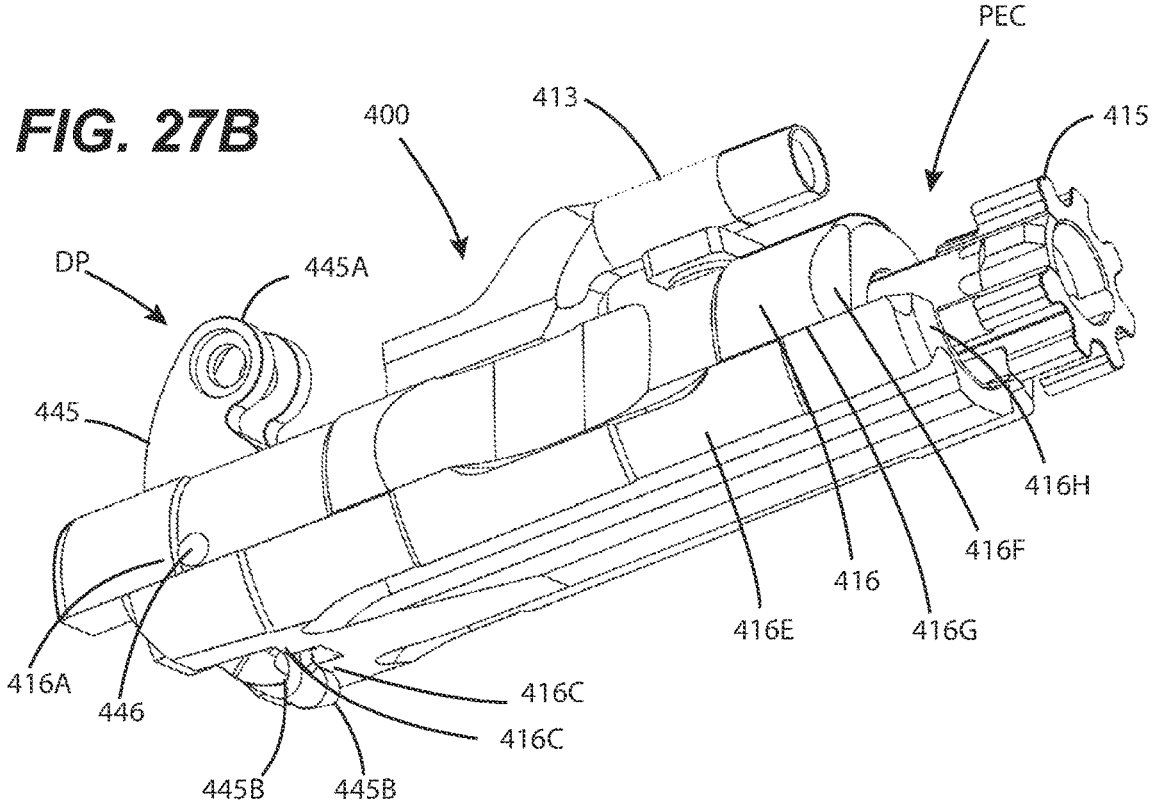
FIG. 27B is a perspective view showing the bolt carrier group of FIG. 27A, where the bolt carrier group is in a primary extraction completed configuration.

Referring now to FIGS. 27A and 27B, a bolt carrier group of a bolt carrier movement mechanism in accordance with a fourth embodiment of the disclosures made herein is discussed (bolt carrier group 400). The bolt carrier group 400 may include a gas key 413, a bolt 415, a bolt carrier 416, and a primary extraction leverage member 445. Such bolt carrier movement mechanism in accordance with the fourth embodiment of the disclosures made herein preferably may include the bolt carrier 416 and the primary extraction leverage member 445 and may optionally include the gas key 413. The gas key 413 and the primary extraction leverage member 445 may be substantially the same or identical to, respectively, the gas key 213 and the primary extraction leverage member 245 disclosed above in reference to FIGS. 19A, 19B, 20A, 20B and 21. Accordingly, the above disclosed structural and operational details as to the bolt carrier gas key 213 and the primary extraction leverage member 245 are applicable to the gas key 413 and the primary extraction leverage member 445.

The bolt carrier 416 includes a lower (i.e., first) portion 416E and an upper (i.e., second) portion 416F. The lower and upper portions 416E, 416F are configured for enabling longitudinal sliding displacement therebetween. In some embodiments, the lower and upper portions 416E, 416F of the bolt carrier 416 may have mating flat faces at an interface 416G thereof for enabling longitudinal sliding displacement therebetween and the central bore of an upper receiver (e.g., the upper receiver 114 discussed above) maintains the lower and upper portions 416E, 416F of the bolt carrier 416 in place relative to each other. In some other embodiments, the lower and upper portions 416E, 416F of the bolt carrier 416 may have mating structure (e.g., tongue, groves, channels, shoulders, or the like) that enabling longitudinal sliding displacement therebetween and that maintains the lower and upper portions 416E, 416F of the bolt carrier 416 in place relative to each other during such sliding displacement.

The primary extraction leverage member 445 includes a coupler mounting portion 445A, impingement member portions 445B, and a bolt carrier mounting portion 445C. The primary extraction leverage member 445 is pivotably engaged at its bolt carrier mounting portion 445C with the rear end portion 416A of the bolt carrier 416 for enabling the primary extraction leverage member 445 to pivot about a pivot axis PA2 extending through a pivot pin 446 that pivotably attaches the primary extraction leverage member 445 to the bolt carrier 416. In some embodiments, the primary extraction leverage member 445 may be engaged with a different portion of the bolt carrier other than its rear end portion 416A (e.g., to a central portion thereof).

Forcible rotation of the primary extraction leverage member 445 from the fully retracted position RP (FIG. 27A) to the fully displaced position DP (FIG. 27B) causes the impingement member portions 445B of the primary extraction leverage member 445 to bear upon a mating impingement portion 416C of the lower portion 416E of the bolt carrier 416. Such forcible rotation of the primary extraction leverage member 445 and resulting engagement of the impingement member portions 445B of the primary extraction leverage member 445 with the mating impingement portion 416C of the lower portion 416E of the bolt carrier 416 causes rearward longitudinal motion of the upper portion 416F of the bolt carrier 416 relative to the lower portion 416E of the bolt carrier 416. In this disclosed embodiment, the lower portion 416E of the bolt carrier 416 is an impingement body of a respective bolt carrier movement mechanism.

In use in a firearm, a front end portion 416H of the lower portion 416E of the bolt carrier 416 bears against a fixed structure of the firearm. Preferably, the fixed structure is made from a sufficiently hard material—e.g., a hardened barrel extension, a hardened steel insert within the lower receiver, a receiver or associated component made from a hardened material, or the like. Accordingly, the rotation of the primary extraction leverage member 445 from the fully retracted position RP to the fully displaced position DP results in rearward movement of the upper portion 416F of the bolt carrier 416 in view of the lower portion 416E of the bolt carrier 416 being inhibited from forward motion relative to the aforementioned fixed structure of the firearm. Thus, in response to the primary extraction leverage member 445 being rotated from the fully retracted position RP to the fully displaced position DP, the upper portion 416F of the bolt carrier 416 is urged rearward from the battery position BP to the primary extraction completed position PEC. Underlying aspects of translation distance and force multiplication factors discussed above apply in this embodiment.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A firearm bolt carrier movement mechanism, comprising:

a bolt carrier;

an impingement body having at least one impingement surface;

a primary extraction leverage member having a coupler mounting portion, an impingement member portion, and a bolt carrier mounting portion, wherein the primary extraction leverage member is engaged at the bolt carrier mounting portion thereof with the bolt carrier for enabling the primary extraction leverage member to pivot about a pivot axis extending through the bolt carrier mounting portion, wherein the impingement member portion of the primary extraction leverage member is adjacent to the at least one impingement surface of the impingement body and includes at least one impingement member; and an action control structure coupler engaged with the coupler mounting portion of the primary extraction leverage member.

2. The firearm bolt carrier movement mechanism of claim 1, further comprising one of:

a lower receiver body having a base portion of the impingement body unitarily-formed therewith from a first material, wherein a durable member portion of the impingement body is attached to the base portion of the impingement body and wherein the durable member portion of the impingement body has a hardness greater than the base portion of the impingement body;

a lower body receiver having an impingement body receiving space formed within a wall thereof, wherein the lower receiver body is formed from a first material, wherein the impingement body is a discrete component made from second material having a hardness greater than the first material, and wherein a base portion of the impingement body is disposed within the impingement body receiving space; and a lower receiver body formed from a first material, wherein the impingement body is a discrete component made from a second material having a hardness greater than the first material and wherein the impingement body is engaged with a wall of the lower receiver body.

3. The firearm bolt carrier movement mechanism of claim 1 wherein the impingement body is one of:

a discrete body slidably engaged with the bolt carrier; and a first portion of a bolt carrier which has a second portion thereof slidably engaged with the first portion thereof.

4. The firearm bolt carrier movement mechanism of claim 1 wherein:

the bolt carrier mounting portion is located between the coupler mounting portion and the impingement member portion; and the primary extraction leverage member provides a primary extraction force multiplication factor of at least 2 as a function of a distance from the pivot axis to a point of attachment of the primary extraction leverage member to the action control structure coupler and a distance from the pivot axis to an impingement body contact portion of the at least one impingement member.

5. The firearm bolt carrier movement mechanism of claim 1 wherein:

the impingement member portion is located between the coupler mounting portion and the bolt carrier mounting portion; and the primary extraction leverage member provides a primary extraction force multiplication factor of at least 3.5 as a function of a distance from the pivot axis to a point of attachment of the primary extraction leverage member to the action control structure coupler and a distance from the pivot axis to an impingement body contact portion of the at least one impingement member.

6. The firearm bolt carrier movement mechanism of claim 1 wherein the action control structure coupler is one of:

a mounting body including at least one of a mounting portion adapted for having an operating rod engaged therewith and a mounting portion adapted for having a charging knob engaged therewith; and a lever coupler pivotably attached at a first end portion thereof to the coupler mounting portion of the primary extraction leverage member and adapted at the second end portion thereof for having an action-control lever pivotably attached thereto.

7. The firearm bolt carrier movement mechanism of claim 1 wherein:

the impingement body is slidably engaged with the bolt carrier; and the action control structure coupler is slidably engaged with the bolt carrier.

8. The firearm bolt carrier movement mechanism of claim 1, further comprising:

a gas key attached to the bolt carrier, wherein the gas key has a gas tube cavity with an inside diameter that is larger than that of an original equipment manufacturer (OEM) gas key of a firearm for which the firearm bolt carrier movement mechanism is adapted for use thereby permitting bypassing of gas between the gas tube cavity and an end portion of a gas tube disposed within the gas tube cavity.

9. The firearm bolt carrier movement mechanism of claim 1, further comprising:

a charging knob having a mounting portion and a hand-grasping portion, wherein the mounting portion is fixedly attached to the action control structure coupler.

10. The firearm bolt carrier movement mechanism of claim 1 wherein:

the action control structure coupler being engaged with the coupler mounting portion of the primary extraction leverage member includes the action control structure coupler being pivotably engaged with the coupler mounting portion of the primary extraction leverage member by a pivot pin extending through an elongated slot in the action control structure coupler; and the action control structure coupler is slidably engaged within an elongated channel within an exterior surface of the bolt carrier.

11. The firearm bolt carrier movement mechanism of claim 1 wherein a lower end portion of the primary extraction leverage member includes the at least one impingement member, the bolt carrier mounting portion, and a firing pin access passage.

12. The firearm bolt carrier movement mechanism of claim 1, further comprising:

a bolt catch, wherein the impingement body is integral with the bolt catch.

13. A kit for constructing a firearm having a manually-energized bolt carrier movement mechanism, comprising:

an impingement body having at least one impingement surface;

a primary extraction leverage member having a coupler mounting portion, an impingement member portion, and a bolt carrier mounting portion, wherein the impingement member portion includes at least one impingement member;

a bolt carrier slidably engageable within a bolt carrier receiving bore of an upper receiver body of the firearm, wherein a portion of the bolt carrier is adapted for having the bolt carrier mounting portion of the primary extraction leverage member engaged therewith; and an action control structure coupler pivotably engageable with the coupler mounting portion of the primary extraction leverage member.

14. The kit of claim 13, further comprising one of:

a lower receiver body having a base portion of the impingement body unitarily-formed therewith from a first material, wherein a durable member portion of the impingement body is attached to the base portion of the impingement body and wherein the durable member portion of the impingement body has a hardness greater than the base portion of the impingement body;

a lower receiver body having an impingement body receiving space formed within a wall thereof, wherein the lower receiver body is formed from a first material, wherein the impingement body is a discrete component made from a second material having a hardness greater than the first material, and wherein a base portion of the impingement body is disposed within the impingement body receiving space; and a lower receiver body formed from a first material, wherein the impingement body is a discrete component made from a second material having a hardness greater than the first material, and wherein the impingement body is engaged with a wall of the lower receiver body.

15. The kit of claim 13 wherein the action control structure coupler is one of:

a mounting body including at least one of a mounting portion adapted for having an operating rod engaged therewith and a mounting portion adapted for having a charging knob engaged therewith; and a lever coupler pivotably attached at a first end portion thereof to the coupler mounting portion of the primary extraction leverage member and adapted at the second end portion thereof for having an action-control lever pivotably attached thereto.

16. The kit of claim 13 wherein:

the bolt carrier mounting portion is located between the coupler mounting portion and the impingement member portion; and the primary extraction leverage member provides a primary extraction force multiplication factor of at least 2 as a function of a distance from a pivot axis extending through the bolt carrier mounting portion about which the primary extraction leverage member pivots to a point of attachment of the primary extraction leverage member to the action control structure coupler and a distance from the pivot axis to an impingement body contact portion of the at least one impingement member.

17. The kit of claim 13 wherein:

the impingement member portion is located between the coupler mounting portion and the bolt carrier mounting portion; and the primary extraction leverage member provides a primary extraction force multiplication factor of at least 3.5 as a function of a distance from a pivot axis extending through the bolt carrier mounting portion about which the primary extraction leverage member pivots to a point of attachment of the primary extraction leverage member to the action control structure coupler and a distance from the pivot axis to an impingement body contact portion of the at least one impingement member.

18. The kit of claim 13 wherein the impingement body is one of:

a discrete body slidably engaged with the bolt carrier and a first portion of a bolt carrier which has a second portion thereof slidably engaged with the first portion thereof.

19. A firearm, comprising:

a receiver body system including an upper receiver body and a lower receiver body matingly attached to the upper receiver body;

a bolt carrier slidably disposed within a central bore of the upper receiver body;

an impingement body having at least one impingement surface, wherein the impingement body is engaged with at least one of the upper receiver body and the lower receiver body;

a primary extraction leverage member having a coupler mounting portion, an impingement member portion, and a bolt carrier mounting portion, wherein the primary extraction leverage member is engaged at the bolt carrier mounting portion thereof to a portion of the bolt carrier, wherein the impingement member portion of the primary extraction leverage member includes at least one impingement member;

an action control structure coupler having a first portion thereof pivotably engaged with the coupler mounting portion of the primary extraction leverage member; and an action control structure attached to a second portion of the action control structure coupler for enabling the bolt carrier to be cycled between a battery position and a fully displaced position.

20. The firearm of claim 19, further comprising:

a bolt catch, wherein the impingement body is integral with the bolt catch.

21. The firearm of claim 19 wherein:

the impingement body includes a durable member portion that is engaged with the lower receiver body; and the durable member portion includes the at least one impingement surface.

22. The firearm of claim 19 wherein one of:

the bolt carrier mounting portion is located between the coupler mounting portion and the impingement member portion; and the impingement member portion is located between the coupler mounting portion and the bolt carrier mounting portion.

23. The firearm of claim 19 wherein the impingement body is one of:

a discrete body slidably engaged with the bolt carrier; and a first portion of the bolt carrier which has a second portion thereof slidably engaged with the first portion thereof.

24. The firearm of claim 19 wherein one of:

a base portion of the impingement body is unitarily-formed with the lower receiver body from a first material, wherein a durable member portion of the impingement body is attached to the base portion of the impingement body and wherein the durable member portion of the impingement body has a hardness greater than the base portion of the impingement body;

the lower receiver body has an impingement body receiving space formed within a wall thereof, wherein the lower receiver body is formed from a first material, wherein the impingement body is a discrete component made from second material having a hardness greater than the first material, and wherein a base portion of the impingement body is disposed within the impingement body receiving space; and the lower receiver body is formed from a first material, wherein the impingement body is a discrete component made from a second material having a hardness greater than the first material and wherein the impingement body is engaged with a wall of the lower receiver body.

25. A bolt carrier group, comprising:

a bolt carrier; and a primary extraction leverage member having a coupler mounting portion, an impingement member portion, and a bolt carrier mounting portion, wherein the primary extraction leverage member is pivotably engaged at the bolt carrier mounting portion thereof with the bolt carrier for enabling the primary extraction leverage member to pivot about a first pivot axis extending through the bolt carrier mounting portion and wherein the coupler mounting portion is positioned above a top surface of the bolt carrier when the primary extraction leverage member is in a battery-providing position.

26. The bolt carrier group of claim 25 wherein a lower end portion of the primary extraction leverage member includes the at least one impingement member, the bolt carrier mounting portion, and a firing pin access passage.

27. The bolt carrier group of claim 25 wherein:

the bolt carrier mounting portion is located between the coupler mounting portion and the impingement member portion; and the primary extraction leverage member provides a primary extraction force multiplication factor of at least 2 as a function of a distance from the first pivot axis to a second pivot axis extending through the action control structure engagement portion about which a coupler engaged therewith pivots and a distance from the first pivot axis to an impingement body contact portion of the at least one impingement member.

28. The bolt carrier group of claim 25 wherein:

the impingement member portion is located between the coupler mounting portion and the bolt carrier mounting portion; and the primary extraction leverage member provides a primary extraction force multiplication factor of at least 3.5 as a function of a distance from the first pivot axis to a second pivot axis extending through the action control structure engagement portion about which a coupler engaged therewith pivots and a distance from the first pivot axis to an impingement body contact portion of the at least one impingement member.

29. The bolt carrier group of claim 25, further comprising:

an action control structure coupler pivotably engaged with the coupler mounting portion of the primary extraction leverage member, wherein the action control structure coupler being pivotably engaged with the coupler mounting portion of the primary extraction leverage member includes the action control structure coupler being pivotably engaged with the coupler mounting portion of the primary extraction leverage member by a pivot pin extending through an elongated slot in the action control structure coupler and wherein the action control structure coupler is slidably engaged within an elongated channel within an exterior surface of the bolt carrier.

30. The bolt carrier group of claim 25 wherein:

the bolt carrier includes a first portion and a second portion slidably engaged with the first portion; and the first portion includes at least one impingement portion adapted for being engaged by the impingement member portion of the primary extraction leverage member.

* * * * *